US012635802B2

(12) United States Patent
Altshuler

(10) Patent No.: US 12,635,802 B2
(45) Date of Patent: May 26, 2026

(54) DECK SEATING ASSEMBLY

(71) Applicant: Edward Lafe Altshuler, Erie, CO (US)

(72) Inventor: Edward Lafe Altshuler, Erie, CO (US)

( * ) Notice: Subject to any disclaimer, the term of this patent is extended or adjusted under 35 U.S.C. 154(b) by 304 days.

(21) Appl. No.: 18/513,603

(22) Filed: Nov. 19, 2023

(65) Prior Publication Data

US 2024/0081543 A1 Mar. 14, 2024

Related U.S. Application Data

(63) Continuation-in-part of application No. 17/006,839, filed on Aug. 30, 2020, now abandoned.

(51) Int. Cl.
*A47C 11/00* (2006.01)
*E04B 1/00* (2006.01)

(52) U.S. Cl.
CPC ..... *A47C 11/00* (2013.01); *E04B 1/003* (2013.01)

(58) Field of Classification Search
CPC ..... E04B 1/003; A47C 11/00; A47C 11/02; A47C 4/03; A47C 7/002
USPC ..... 297/217.7
See application file for complete search history.

(56) References Cited

U.S. PATENT DOCUMENTS 3,329,465 A * 7/1967 King ..... A47C 11/00 297/446.1
3,405,972 A * 10/1968 Morris ..... A47C 15/004 297/14
4,285,542 A * 8/1981 Boisvert ..... A47C 11/00 297/217.7
5,337,471 A * 8/1994 Graney ..... A47C 15/004 29/525.04
5,427,437 A 6/1995 Lacasse
5,653,502 A * 8/1997 Kimura ..... A47C 1/126 297/331
7,131,699 B2 11/2006 Mulmed
7,267,403 B2 * 9/2007 Conner ..... A47C 1/12 297/217.7
7,631,934 B2 * 12/2009 Mac Isaac ..... A47C 1/16 297/352
11,653,767 B1 * 5/2023 Jackson ..... A47C 7/40 297/452.1
12,390,014 B1 * 8/2025 Rodriguez ..... A47C 1/028
2002/0074837 A1 * 6/2002 Rivers ..... A47C 1/126 297/217.7

(Continued)

FOREIGN PATENT DOCUMENTS

DE 202013104029 12/2014
KR 100914716 8/2009

*Primary Examiner* — Jose V Chen
(74) *Attorney, Agent, or Firm* — Kenneth Altshuler

(57) ABSTRACT

Disclosed herein are embodiments describing a seat deck panel that is defined by at least an outer perimeter. The outer perimeter includes: a base edge, a seat edge and a cap rail edge that are parallel to one another and extend in a horizontal direction, a base-to-seat edge that joins the base edge joins the seat edge, a back rest edge that joins the seat edge to the cap rail edge, the back rest edge is at an angle α from the horizontal direction between 65° and 90° from the horizontal direction, a rear edge that extends between the cap rail edge and at least to the base edge. The seat deck panel can cooperate with a plurality of other like seat deck panels to be mounted to a deck and assembled with seat planks for outdoor deck seating.

20 Claims, 17 Drawing Sheets

(56) References Cited

U.S. PATENT DOCUMENTS

| | | | | |
|---|---|---|---|---|
| 2004/0189064 | A1* | 9/2004 | Gross | A47C 7/002 297/217.7 |
| 2005/0161985 | A1 | 7/2005 | Austin | |
| 2005/0253435 | A1 | 11/2005 | Walker | |
| 2010/0096898 | A1* | 4/2010 | Senephimmachack | A47C 4/03 297/440.1 |
| 2011/0316312 | A1 | 12/2011 | Boydston | |
| 2014/0217790 | A1* | 8/2014 | Stavros | B60N 2/24 297/217.7 |
| 2017/0224120 | A1 | 8/2017 | Georgiadis et al. | |
| 2018/0325266 | A1 | 11/2018 | White et al. | |
| 2021/0395993 | A1* | 12/2021 | Wagner, III | E04F 15/02411 |
| 2022/0061538 | A1* | 3/2022 | Altshuler | E04B 1/003 |

* cited by examiner

DECK SEATING ASSEMBLY

CROSS-REFERENCE TO RELATED APPLICATIONS

This continuation-in-part application claims priority to and the benefit of U.S. patent application Ser. No. 17/006,839 entitled: Deck Seating Assembly filed on Aug. 20, 2020.

FIELD OF THE INVENTION

The present embodiments are directed to a deck chair assembly.

DESCRIPTION OF RELATED ART

Outside decks create an outdoor space for people to gather and relax. Deck chairs and lounges provide seating for people and can easily be repositioned due to their mobility. However, wind can sometimes move deck chairs and lounges across and even off deck surfaces, which is irritating at the least.

It is to innovations related to this subject matter that the embodiments of the invention is generally directed.

SUMMARY OF THE INVENTION

The present embodiments are directed to a deck seat support configuration for a deck chair assembly Certain embodiments of the present invention contemplate a deck seat support stay comprising that generally comprises a sheet metal front panel defined by at least an outer front perimeter that includes a base edge, a seat edge and a cap rail edge that are parallel to one another and extend in a horizontal direction, a base-to-seat edge that joins the base edge and joins the seat edge, a back rest edge that joins the seat edge to the cap rail edge, the back rest edge is at an angle β from the horizontal direction between 65° and 90° from the horizontal direction, and a rear edge that extends between the cap rail edge and at least to the base edge. The deck seat support stay further comprises a sheet metal back panel defined by an outer back perimeter that is substantially a mirror-image of the sheet metal front panel. The sheet metal front panel and the sheet metal back panel are joined and spaced apart via stay sides, wherein the sheet metal front panel, the sheet metal back panel and the stay sides are less than 0.3 inches thick. The deck seat support stay is hollow and is attached to a patio deck.

Another embodiment of the present invention envisions a deck seat stay that generally comprises a unitary front panel consisting of sheet metal that is less than 0.3 inches thick with a perimeter that includes a base edge defined in a horizontal direction, a base-to-seat edge extending from the base edge to a seat edge, the base edge joins the seat edge at a seat edge leading end, the seat edge is vertically above the base edge, a back rest edge extending at an angle β between 60° and 90° from the horizontal direction and terminating at a cap rail edge, the back rest edge extending in a positive vertical direction from a seat edge trailing end, the cap rail edge extending in the horizontal direction and terminating into a rear edge, the rear edge extending between the base edge to the cap rail edge at an angle α from the horizontal direction between 65° and 90° from the horizontal direction. The deck seat stay further including a unitary back panel that is substantially identical and a mirror image of the unitary front panel. The unitary back panel is joined to the unitary front panel via a perimeter side that spans the perimeter, wherein the perimeter side is less than 0.3 inches thick. In this embodiment, the deck seat stay is a hollow box structure. A hollow box structure is not merely a compartment in the deck seat stay but the void that makes up the interior volume between the unitary front and back panels and as well as the perimeter side dominates the volume of the deck seat stay.

Still another embodiment of the present invention envisions a deck seat stay comprising a front panel that is a unitary sheet of metal less than 0.3 inches thick. The front panel has a perimeter that includes a base edge, a seat edge and a cap rail edge that are defined in a horizontal direction when the deck seat stay is mounted to a deck, a back rest edge extending from the seat edge to the cap rail edge at an angle β between 60° and 90° from the horizontal direction. A back panel that is substantially identical and a mirror image of the front panel is joined to the front panel via a perimeter side that is less than 0.3 inches thick. The deck seat stay is configured to attach to a patio deck. The front panel can optionally have a front panel stay side that overlaps and is affixed to a back panel stay side of the back panel.

Other embodiments of the present invention contemplate a deck seat support stay comprising: a front face of a front panel defined by at least an outer front perimeter that includes a base edge, a seat edge and a cap rail edge that are parallel to one another and extend in a horizontal direction, a base-to-seat edge that joins the base edge a back rest edge that joins the seat edge to the cap rail edge, the back rest edge is at an angle β from the horizontal direction between 65° and 90° from the horizontal direction, a rear edge that extends between the cap rail edge and at least to the base edge; a back face of a back panel defined by an outer back perimeter that is a mirror-image of the front face; and stay sides extend in the Z direction from the front face to the back face and joins the front face to the back face.

Other certain embodiments of the present invention contemplate a deck seat panel comprising: a front panel defined by a perimeter that includes a base edge defined in a horizontal direction, a base-to-seat edge extending at least partially vertically to join a seat edge at a seat edge leading end, the seat edge is vertically above the base edge, a back rest edge extending at an angle β between 60° and 90° from the horizontal direction and terminating at a cap rail edge, the back rest edge extending in a positive direction from a seat edge trailing end, the cap rail edge extending in the horizontal direction and terminating into a rear edge, the rear edge extending from the base edge to the back rest edge at an angle α from the horizontal direction between 65° and 90° from the horizontal direction; and a back panel that is the mirror image of the front surface, the back surface joined to the front surface via a perimeter side.

Yet other certain embodiments of the present invention contemplate a deck seat component comprising: a panel defined by a deck seat perimeter, the deck seat perimeter defined by a rear edge extending in a positive vertical direction at an angle α between 55° and 90°, the angle α having an α-base defined from a positive horizontal direction, the rear edge connecting to a top-to-rear edge, top-to-rear edge extending in the positive vertical direction at an angle α between 55° and 90° from the rear edge, the top-to-rear edge connecting to a cap rail edge, the cap rail edge extending in a negative horizontal direction at an angle α of approximately 0° from the top-to-rear edge, the cap rail edge connecting to a back rest edge, the back rest edge extending in a negative vertical direction at an angle β between 55° and 90° from the cap rail edge, the angle β having a β-base defined from the positive horizontal direction, the back rest edge is connected to a seat edge, the seat edge extending in a negative horizontal direction at an angle α of approximately 0° from the back rest edge, the seat edge is connected to base-to-seat edge, the base-to-seat edge extending in the negative vertical direction from the seat edge, the base-to-seat edge connected to a base edge, the base edge extending in the positive horizontal direction at an angle α of approximately 0°, the base-to-seat edge extending from the base edge in a positive vertical direction at an angle α of between 90° and 120°, the base edge extending toward the rear edge.

DETAILED DESCRIPTION

Initially, this disclosure is by way of example only, not by limitation. Thus, although the instrumentalities described herein are for the convenience of explanation, shown and described with respect to exemplary embodiments, it will be appreciated that the principles herein may be applied equally in other similar configurations involving the subject matter directed to the field of the invention. The phrases "in one embodiment", "according to one embodiment", and the like, generally mean the particular feature, structure, or characteristic following the phrase, is included in at least one embodiment of the present invention and may be included in more than one embodiment of the present invention. Importantly, such phases do not necessarily refer to the same embodiment. If the specification states a component or feature "may", "can", "could", or "might" be included or have a characteristic, that particular component or feature is not required to be included or have the characteristic. As used herein, the terms "having", "have", "including" and "include" are considered open language and are synonymous with the term "comprising". Furthermore, as used herein, the term "essentially" is meant to stress that a characteristic of something is to be interpreted within acceptable tolerance margins known to those skilled in the art in keeping with typical normal world tolerance, which is analogous with "more or less." For example, essentially flat, essentially straight, essentially on time, etc. all indicate that these characteristics are not capable of being perfect within the sense of their limits. Accordingly, if there is no specific +/− value assigned to "essentially", then it is implied that essentially means to be within +/−2.5% of an exact value unless expressly stated otherwise. The term "connected to" as used herein is to be interpreted as a first element physically linked or attached to a second element and not as a "means for attaching" as in a "means plus function". In fact, unless a term expressly uses "means for" followed by the gerund form of a verb, that term shall not be interpreted under 35 U.S.C. § 112(f). In what follows, similar or identical structures may be identified using identical callouts.

With respect to the drawings, it is noted that the figures are not necessarily drawn to scale and are diagrammatic in nature to illustrate features of interest. Descriptive terminology such as, for example, upper/lower, top/bottom, horizontal/vertical, left/right and the like, may be adopted with respect to the various views or conventions provided in the figures as generally understood by an onlooker for purposes of enhancing the reader's understanding and is in no way intended to be limiting. All embodiments described herein are submitted to be operational irrespective of any overall physical orientation unless specifically described otherwise, such as elements that rely on gravity to operate, for example.

Figure 8A:
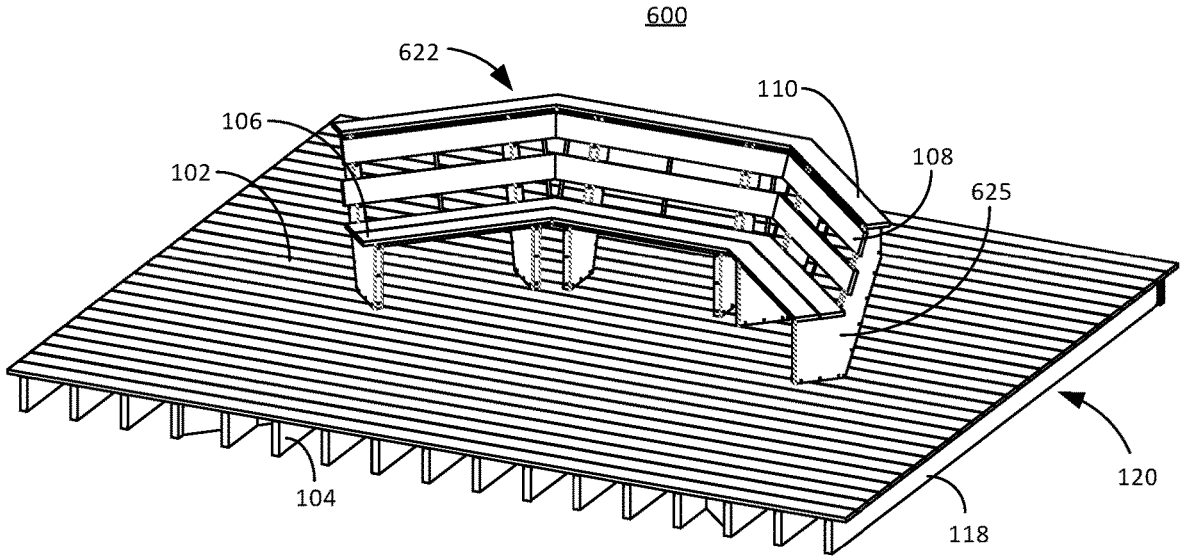
FIGS. 8A and 8B are line drawings of yet another outdoor deck embodiment with surface mount deck seating consistent with embodiments of the present invention.

Disclosed herein are embodiments describing a deck seat stay that is part of an assembly for a deck seating arrangement whereby certain embodiments envision an edge deck seat arrangement example (shown in FIG. 1A) or a center deck seat arrangement example (shown in FIG. 8A). Each deck seat comprises a deck seat stay that generally includes a panel defined by a deck seat perimeter. Certain embodiments contemplate the deck seat perimeter being defined by a rear edge extending in a positive vertical direction at an angle α between 55° and 90°, the angle α having an α-base defined from a positive horizontal direction. The rear edge connecting to a top-to-rear edge, the top-to-rear edge extending in the positive vertical direction at an angle α between 55° and 90° from the rear edge. The top-to-rear edge connecting to a cap rail edge, the cap rail edge extending in a negative horizontal direction at an angle α of approximately 0° from the top-to-rear edge. The cap rail edge connecting to a back rest edge, the back rest edge extending in a negative vertical direction at an angle β between 55° and 90° from the cap rail edge, the angle β having a β-base defined from the positive horizontal direction. The back rest edge is connected to a seat edge, the seat edge extending in a negative horizontal direction at an angle α of approximately 0° from the back rest edge, the seat edge is connected to base-to-seat edge, the base-to-seat edge extending in the negative vertical direction from the seat edge. The base-to-seat edge connected to a base edge, the base edge extending in the positive horizontal direction at an angle α of approximately 0°. The base-to-seat edge extending from the base edge in a positive vertical direction. The base edge extending toward the rear edge.

Figure 1A:
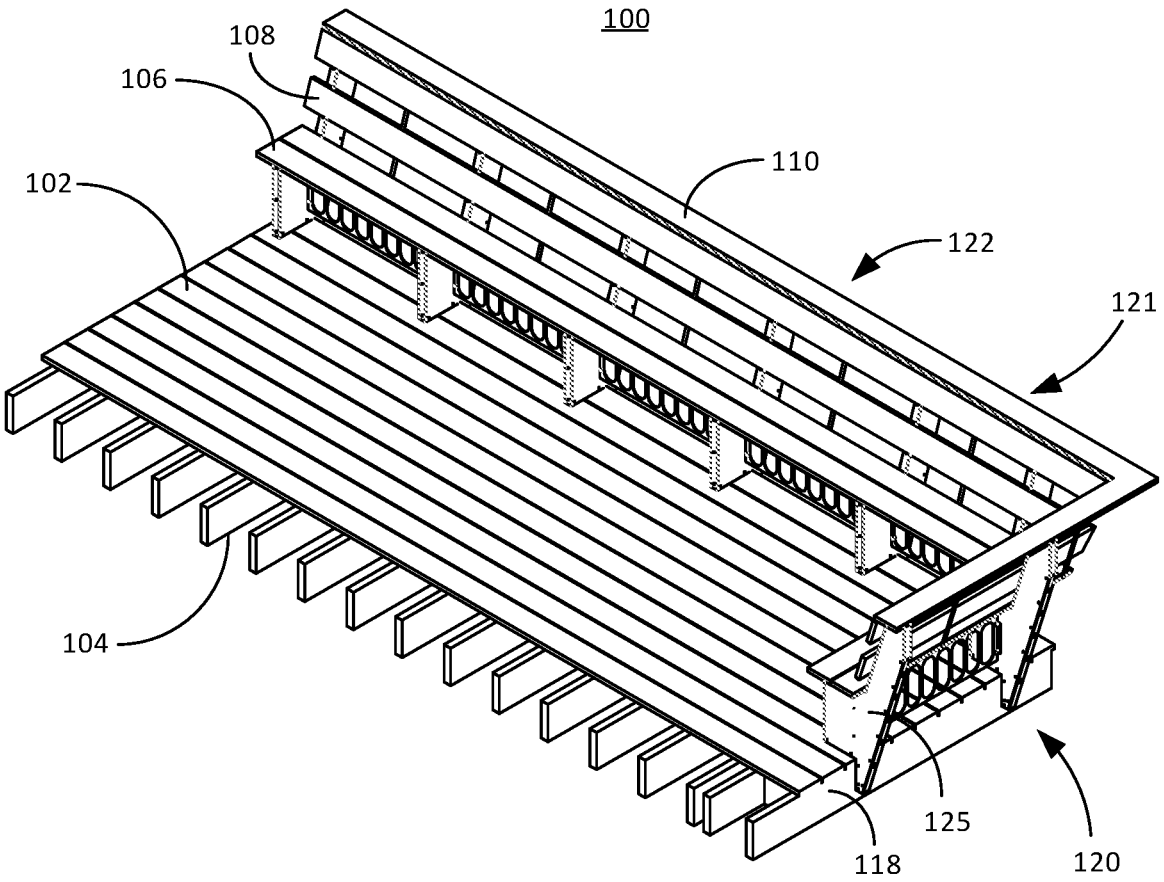
FIGS. 1A and 1B are line drawings of an outdoor deck embodiment with an edge mount deck seating embodiment consistent with embodiments of the present invention.
Figure 1B:
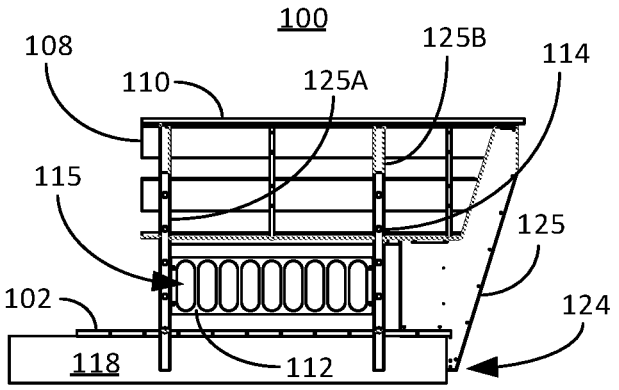

(FIGS. 1A and 1B are line drawings of an outdoor deck embodiment with an edge mount deck-seating embodiment consistent with embodiments of the present invention. FIG. 1A is an isometric line drawing of the outdoor deck 100 with edge mount deck seating 122 consistent with embodiments of the present invention. Some of the major components of the edge mount deck embodiment 100 include a plurality of edge mount deck support stays 125 dispersed along the deck edge (rim joist) 118, deck planks (decking) 102 attached to deck joists 104, deck seat planks 106, deck seat backing planks 108 and a cap rail 110. As should be appreciated, the deck joists 104 make up the deck frame and can be supported off the ground by posts (not shown). The deck joists 104 are essentially evenly distributed in a parallel arrangement except for around the edge of the rim joist 118. The joists 104 are typically dispersed between 10 inches and 2 feet apart. The decking 102 is attached to the joists 104, such as by way of deck screws (not shown). The edge mount deck support stays 125 (hereinafter "edge mount stays") can be secured to the decking 102 and the deck edge 118 by way of L-brackets 260 (shown in FIG. 3A). In the present embodiment, the edge mount stays 125 are more or less evenly distributed along the deck edge 118. Deck seat planks 106 are mounted, or otherwise attached, to a seat edge portion 206 of the edge mount stays 125 (of FIG. 2A). Deck seat backing planks 108 are mounted, or otherwise attached, to a backrest edge portion 208 of the edge mount stays 125 (of FIG. 2A). A cap rail 110 is mounted to a cap rail edge portion 210 at the top of the edge mount stays 125 (of FIG. 2A).

FIG. 1B shows a side view line drawing of the deck side 120 consistent with embodiments of the present invention. From this perspective, a decorative base panel 112 spans between the two side edge mount stays 125A and 125B. The decorative base panel 112 can include any number of decorative shapes, whereby in this example there are oblong perforations 115. The decorative base panel 112 is mounted to the face 251 (see FIG. 2C) of the edge mount stay 125A and the face 201 of edge mount stay 125B at the base-to-seat edges 212 of the two side edge mount stays 125A and 125B (of FIG. 2A). Additional decorative base panel/s 112 are mounted between the stays 125 along the deck back 121. In the present embodiment, lighting holes 114 are dispersed along the rear stay side 250 of the edge mount stays 125 (of FIG. 3A). Lighting holes may or may not exist depending on the embodiment.

Figure 2A:
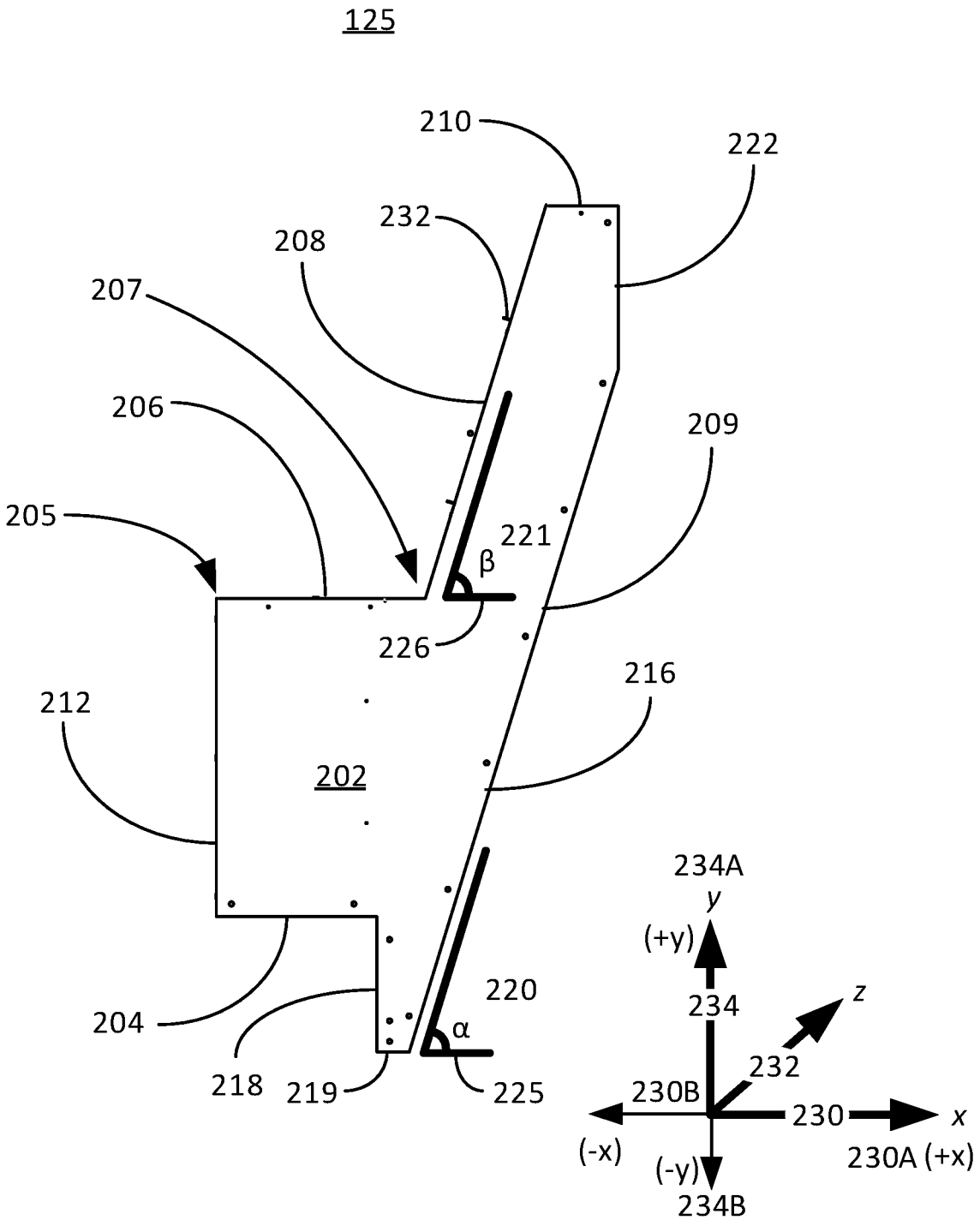
FIGS. 2A-2C are various line drawing views of an edge mount stay embodiment consistent with embodiments of the present invention.
Figure 2B:
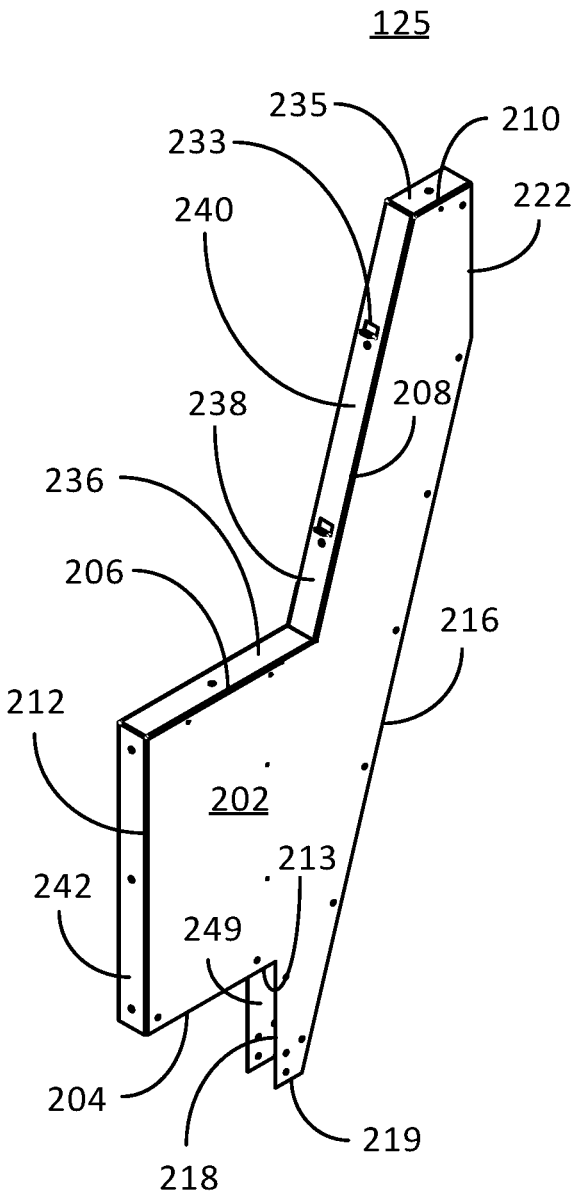
Figure 2C:
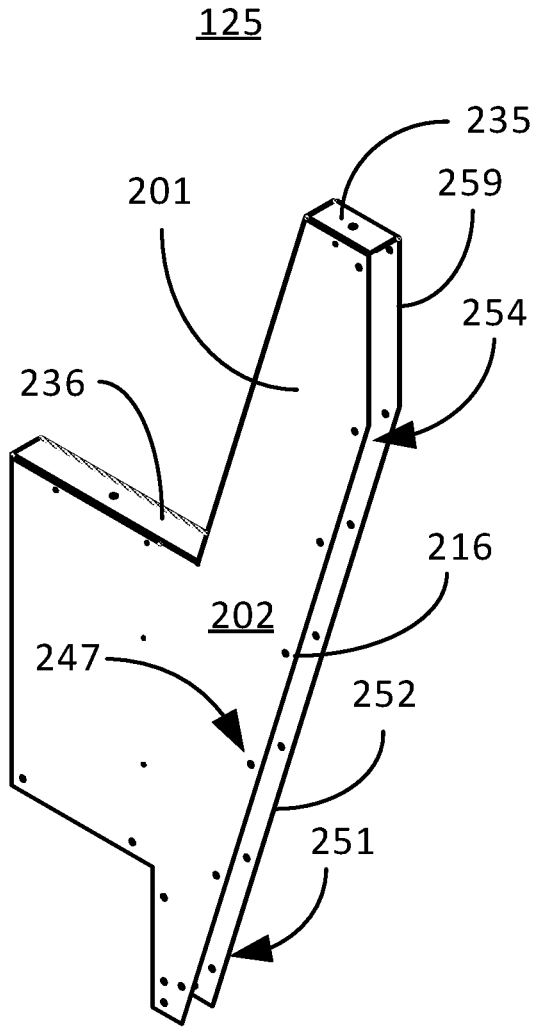

FIGS. 2A-2C are various line drawing views of an edge mount stay embodiment consistent with embodiments of the present invention. FIG. 2A illustratively shows a side view of the front panel 202 the edge mount stay embodiment 125 shown in FIGS. 1A and 1B. The outer front perimeter 209 of the front panel 202 (the front face 201 is shown and labeled in FIG. 2C) is geometrically defined by a plurality of edges. In this embodiment the outer perimeter 209 is defined by a base edge 204 that is connected to a base-to-seat edge 212 that is connected a seat edge 206 that is connected to a seat trailing edge 208 that is connected to a cap rail edge 210 that is connected to a top-to-rear edge 222 that is connected to rear edge 216 that is connected to a lip edge joiner 219 that is connected to a lip edge 218 that is connected to the base edge 204. More specifically, the base edge 204, the seat edge 206 and the cap rail edge 210 are parallel to one another, all extending in the horizontal 'x' direction 230. The base-to-seat edge 212 joins the base edge 204 and the seat edge 206, which in this embodiment is in the vertical 'y' direction 234. Optional embodiments envision the base-to-seat edge 212 being at an angle between 60° and 120° from the positive horizontal '+x' direction 230A. In that light, an angle of 120° will increase the length of the seat edge 206 by extending out the seat edge leading and 205 therefore accommodating a larger seat with potentially more deck seat planks 106. The cap rail edge 210 is horizontal 230, which is well suited for drinks or other objects to be set thereon. It should be appreciated that the top rail does not need to be horizontal. The backrest edge 208 extends at an angle β 221 between 60° and 90° from the horizontal '+x' direction 230A from a seat trailing end 207 to the cap rail edge 210. The backrest edge 208 ultimately supports deck backing planks 108. Some embodiments contemplate a more comfortable backrest position for person sitting on a bench that is built with a plurality of surface mount stays 625 (of FIG. 9A) having an angle β 221 between 60° and 80° (and in some embodiments the angle β 221 in envisioned between 60°) and 90° from the horizontal '+x' direction 230A. In the present embodiment, the top-to-rear edge 222 is vertical 234 (in the 'y' direction) and extends from the cap rail edge 210 to the rear edge 216, which is at an angle α 220 between 65° and 90° from the horizontal '+x' direction 230A. In this arrangement the angle β 221 is the same as the angle α 220. It should be appreciated that the top-to-rear edge 222 need not be vertical 234 but can be at other angles, such as the angle β 221 (essentially making the top-to-rear edge 222 and extension of the rear edge 216). The rear edge 216 terminates at a lip edge joiner 219, which is a horizontal member between a lip edge 218 and the rear edge 216. The lip edge 218 is at 90° to the base edge 204 and facilitates attaching the edge mount stay 125 to the deck edge 118. Certain embodiments contemplate not having a lip edge joiner 219 whatsoever whereby the rear edge 216 simply terminates into the lip edge 218 at a point. The term connected as used in this embodiment means that one edge joins another edge by way of a corner, such as the base-to-seat edge 212 connected to the seat edge 206 by way of corner 205 or the seat edge 206 being connected to the backrest edge 208 by way of corner 207.

Certain embodiments envision the deck seat perimeter 209 being defined by a plurality of edges. For example, the rear edge 216 extending in a positive vertical direction 234A at an angle α 220 between 55° and 90° and a length of between 26 and 46 inches, the angle α 220 having an α-base 225 defined from a positive horizontal direction 230A. The rear edge 216 connecting to a top-to-rear edge 222, the top-to-rear edge 222 having a length of 0-10 inches and extending in the positive vertical direction 234A at an angle α 220 between 55° and 90° from the rear edge 216. The top-to-rear edge 222 connecting to a cap rail edge 210 having a length of 3-10 inches, the cap rail edge 210 extending in a negative horizontal direction 230B at an angle α 220 of approximately 0° from the top-to-rear edge 222. The cap rail edge 210 connecting to a back rest edge 208, the back rest edge 208 having a length of between 16 and 26 inches extends in a negative vertical direction 234B at an angle β 221 between 55° and 90° from the cap rail edge 210, the angle β 221 having a β-base 226 defined from the positive horizontal direction 230A. The back rest edge 208 is connected to a seat edge 206, the seat edge 206 having a length of 7-16 inches extends in a negative horizontal direction 230B at an angle α 220 of approximately 0° from the back rest edge 208. The Seat edge 206 is connected to base-to-seat edge 212, the base-to-seat edge 212 extending in the negative vertical direction 234B from the seat edge 206 and has a length of between 14 and 20 inches. The base-to-seat edge 212 connected to a base edge 204. The base edge 204 extends in the positive horizontal direction 230A at an angle α 220 of approximately 0° and has a length of 6 to 15 inches. The base-to-seat edge 212 can extend from the base edge 204 in a positive vertical direction 234A at an angle α 220 of between 90° and 120°. The base edge 204 extending toward the rear edge 216. Optionally, a lip edge 218 can be connected to the base edge 204 with a length of 0-9 inches and extend in the negative vertical direction 234B at 90° from the base edge 204. The lip edge 218 connects either directly with the rear edge 216 or indirectly by way of a lip edge joiner 219. The lip edge joiner 219 can have a length of between 0 and 4 inches.

FIG. 2B shows a front view isometric line drawing of the edge mount stay embodiment whereby the front panel 202 is separated from the back panel 252 by way of stay sides 240 that extend in the 'z' direction 232. In this embodiment, the back panel 252 is substantially the mirror image of the front panel 202. The stay sides 240 join the front panel 202 to the back panel 252 to create a hollow box like structure. The stay sides 240 shown in this perspective include a base-to-seat side 242, a seat side 236, a bracket side 238 and a cap rail side 235, which can be a single sheet metal element or individual sheet metal elements. Certain embodiments envision the stay sides 240 being U-shaped and fitting inside/between the front panel 202 (on the front panel interior surface 213) and the rear panel 252 (on the rear panel interior surface 249). The U-shaped stay sides 240 can be attached to the front panel 202 and the rear panel 252 by way of bolts or screws (not shown) via threaded holes 247. Optionally, the U-shaped sides 240 can be snapped in place by way of snapping features (not shown) that would be known and understood by those skilled in the art. At least two backing support lips 233 extend from the backrest side 238 to support and align deck seat backing planks 108. In yet another embodiment, the front panel 202 has a front panel lip (not shown) extending in the positive 'z' direction 232 and the rear panel 252 has a rear panel lip (not shown) extending in the negative 'z' direction 232. The front panel 202 is either slightly larger or smaller than the rear panel 252 so that the front panel lip 275 overlaps the rear panel lip 276 in what is considered 'shelling' the two panels together, as shown in FIGS. 4F and 4G. The shelled panels 202 and 252 can be attached together by screws, bolts, snaps, etc., along the shelled front and rear lips when the front panel 202 is physically joined to the rear panel 252.

FIG. 2C shows a back view isometric line drawing of the edge mount stay embodiment of FIG. 2B. Because there is no stay side 240 covering the rear edge 216 as shown from this vantage, the hollow space 254 defined between front panel 202 and the back panel 252 is readily seen. For reference, the back surface 251 of the back panel is pointed to by an arrow. In certain embodiments, the stay sides 240 and the stay lips 275 and 276 have a thickness 272 that are about ⅛ of an inch thick while in other embodiments the stay side widths are less 0.3 inches thick, as shown in FIG. 4F.

Figure 3A:
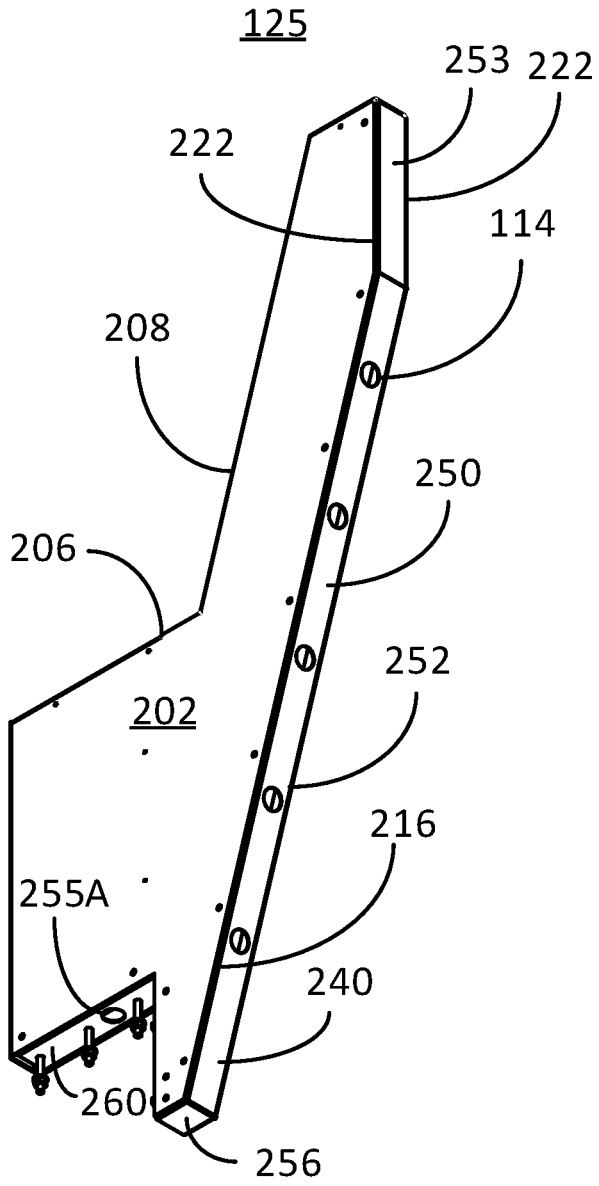
FIGS. 3A-3B are various line drawing views of an edge mount stay with all of the stay sides installed consistent with embodiments of the present invention.
Figure 3B:
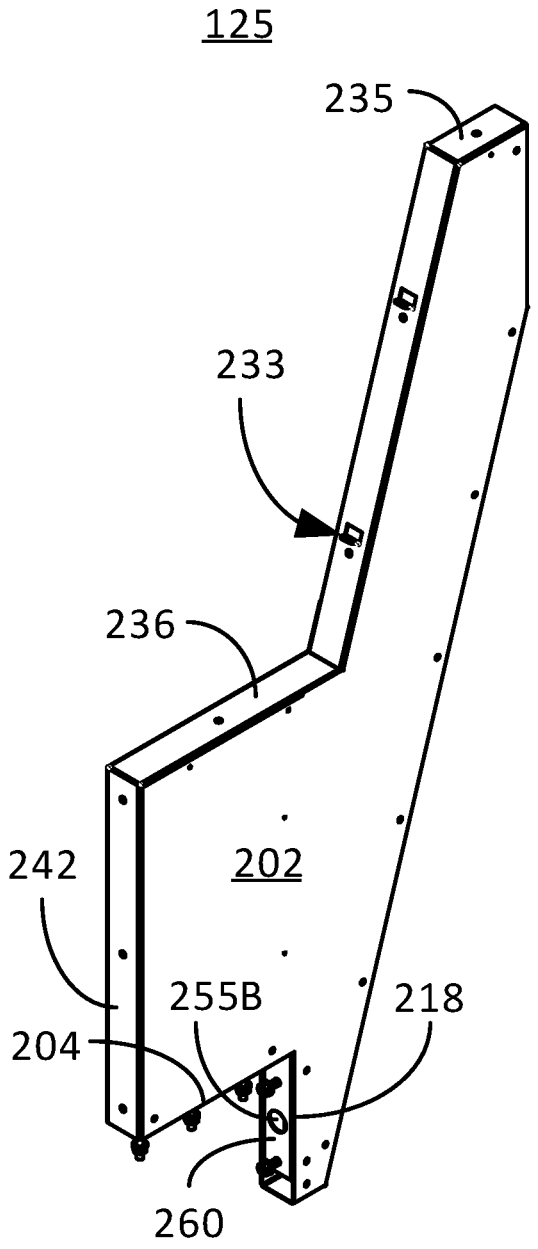

FIGS. 3A-3B are various line drawing views of an edge mount stay with all the stay sides installed consistent with embodiments of the present invention. FIG. 3A is a back view isometric line drawing of the edge mount stay embodiment 125 showing the hollow space 254 of FIG. 2C covered with stay sides 240. More specifically, the top-to-rear edges 222 are connected to a top-to-rear stay side 253 and the rear edges 216 are connected to a rear stay side 250. The rear stay side 250 possesses a plurality of lights 214, such as LEDs, which can be dispersed in any number of patterns that may differ from the distribution shown. An edge mounting bracket 260 is shown connected to the lip edge 218 and the base edge 204. The edge mounting bracket 260 possesses an optional electrical conduit aperture 255A through which an electrical wire (not shown) can be fed to supply power to the lights 214. FIG. 3B is a front view isometric line drawing of the edge mount stay embodiment 125 showing the bottom portion of the edge mounting bracket 260 that possesses an optional electrical conduit aperture 255B through which an electrical wire (not shown) can be fed to supply power to the lights 214.

Figure 4A:
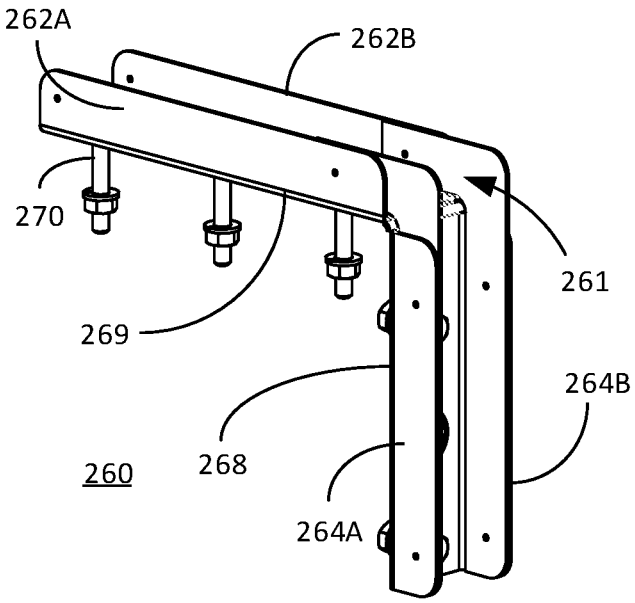
FIGS. 4A-4D are various line drawing views of an edge mount bracket consistent with embodiments of the present invention.

FIGS. 4A-4D are various line drawing views of an edge mount bracket embodiment consistent with embodiments of the present invention. FIG. 4A is an isometric line drawing prominently showing the channel 261 in the edge mount bracket 260, as well as other features. As shown, the edge mount bracket 260 has a plurality of bolts 270 configured to mount to the deck 100. More specifically, in this embodiment three bolts 270 extend from the bracket decking surface 269 to fixedly attach or otherwise lock onto to the decking surface 102 via cooperating nuts. Similarly, two bolts 270 extend from the bracket deck edge surface 268 to fixedly attach to the deck edge 118 when the nuts are tightened around the bolts 270. The cooperating base edge channel sides 262A and 262B matingly butt-up against and attach to the interior surfaces of the front panel 202 and top-to-rear stay side 253 at the joists 104, i.e., the base edge channel sides 262A and 262B extend into the interior of the stay 125. Likewise, the cooperating lip edge channel sides 264A and 264B matingly butt-up against and attach to the interior surfaces of the front panel 202 and rear panel 252 at the lip edge 218.

Figure 4B:
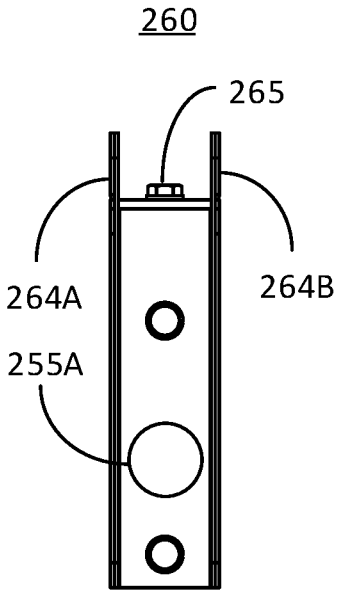
Figure 4C:
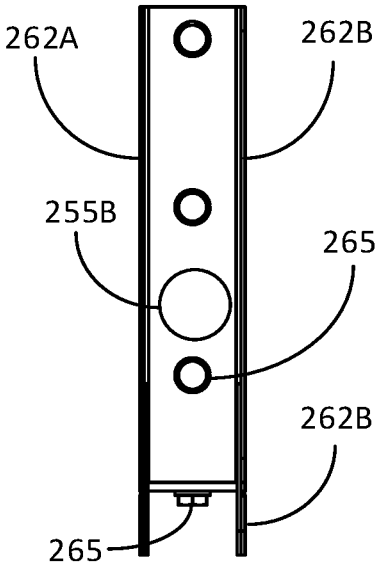

FIGS. 4B and 4C are top views of the interior channel portions of the lip edge channel sides 264A and 264B and the base edge channel sides 262A and 262B, respectively. For reference the two optional electrical conduit apertures 255A and 255B are shown.

Figure 4D:
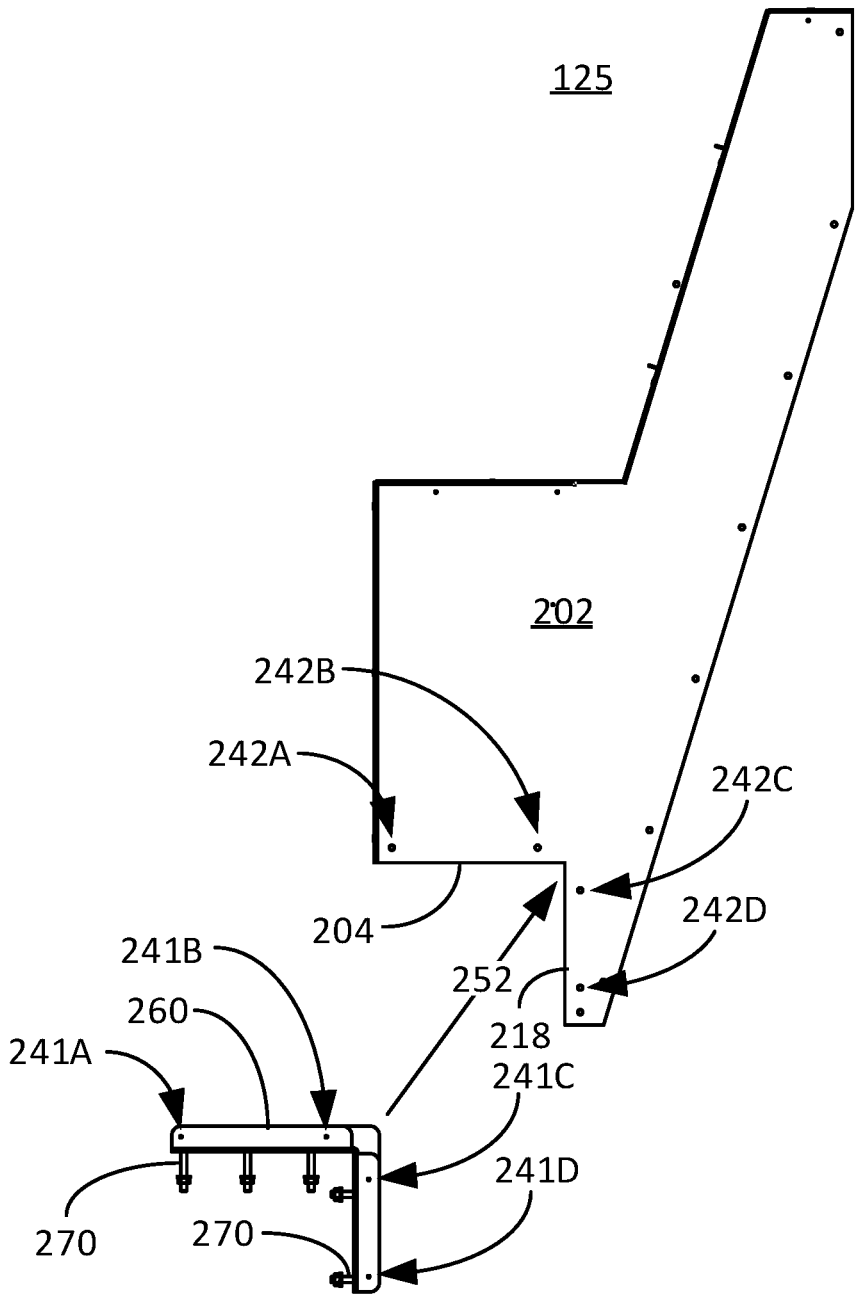
Figure 4E:
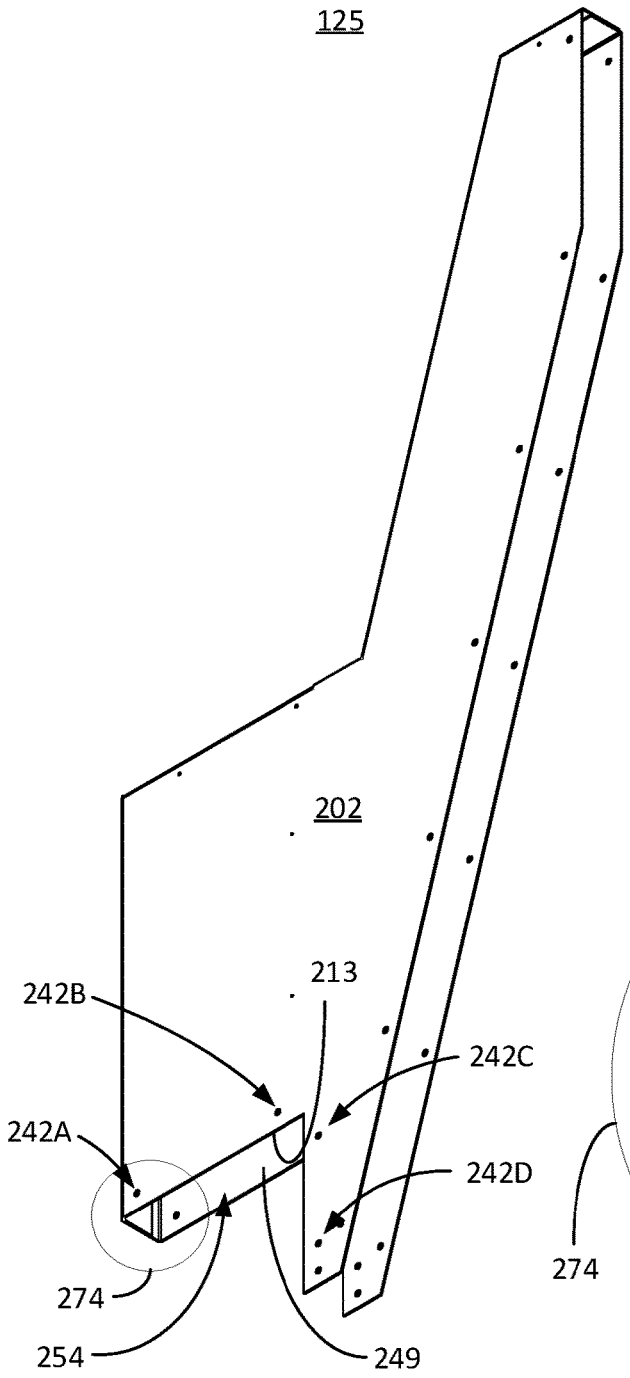
FIG. 4E shows an isometric underside view of the edge mount stay of FIGS. 4A-4D consistent with embodiments of the present invention.
Figure 4F:
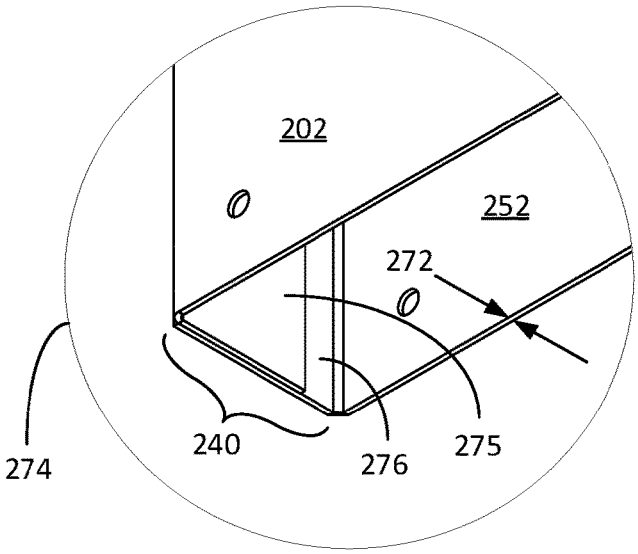
FIGS. 4F and 4G depict a front stay panel and a rear stay panel shelled together consistent with embodiments of the present invention.
Figure 4G:
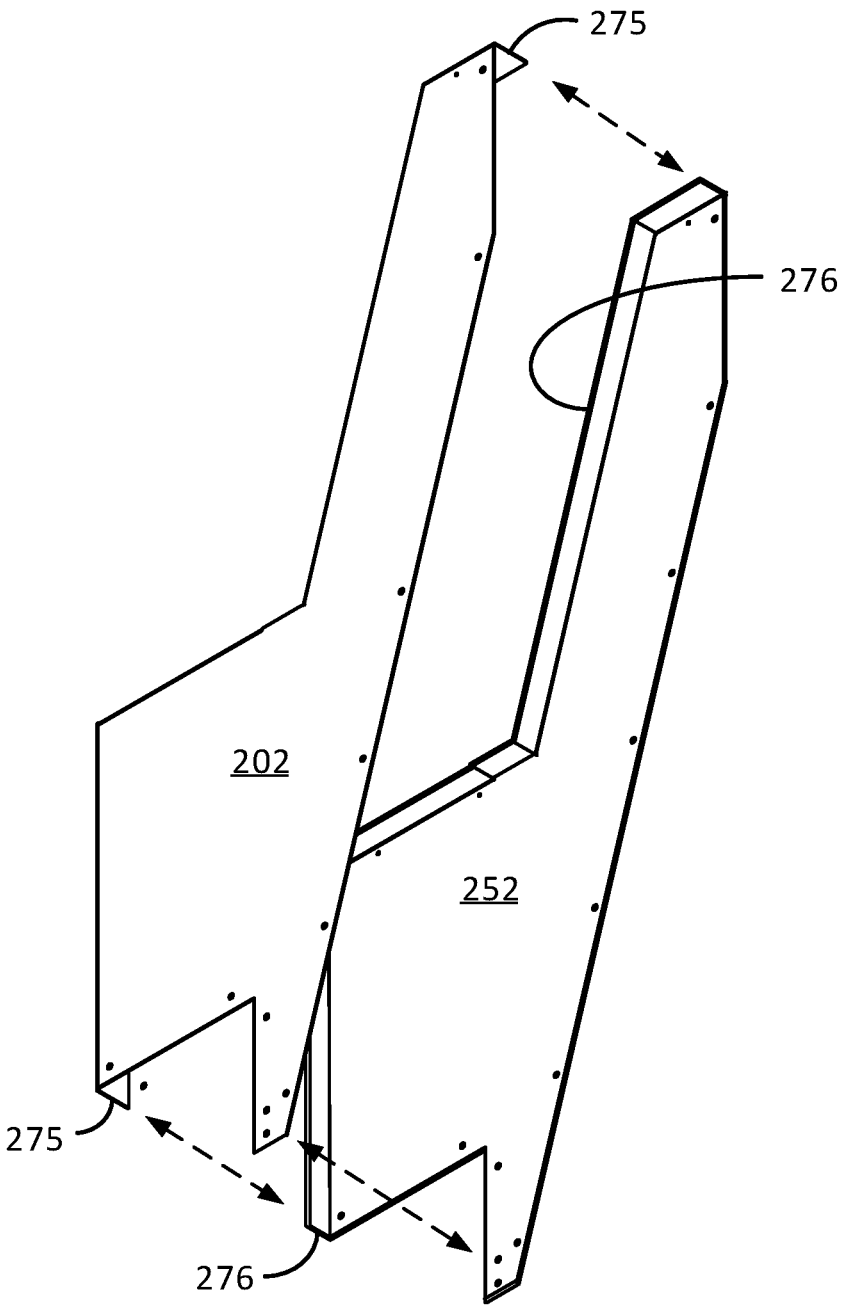

FIG. 4D is a side view line drawing of an edge mount stay embodiment being connected to an edge mount bracket embodiment consistent with embodiments of the present invention. As shown by the arrow 252, the edge mount bracket 260 engages the interior surfaces of the front panel 202 and back panel 252 at the base edge 204 and the lip edge 218. The edge mount bracket 260 becomes part of the stays 125 when connected to the front panel 202 and the back panel 252, such as via pins or bolts (not shown) at attachment holes 241A to 242A, 241B to 242B, 241C to 242C, and 241D to 242D. In practice, the edge mount bracket 260 is first attached to the deck surface 102 and deck sides 118 and then the edge mount stay 125 is bolted or otherwise attached to the edge mount bracket 260 by way of the edge mount bracket 260 sliding into the hollow space 254. FIG. 4E shows an isometric underside view of the edge mount stay 125 showing the hollow space 254 where the edge mount bracket 260 is intended to slide into or otherwise be covered by the front and back panels 202 and 252.

FIG. 4F is a close-up view of the panel portion within the circle 274 depicting the front panel lip 275 overlapping the rear panel lip 276 in what is considered 'shelling' the two panels together. The shelled panels 202 and 252 can be attached together by screws, bolts, snaps, etc., along the shelled front and rear lips when the front panel 202 is physically joined to the rear panel 252.

FIG. 4G shows the front panel 202 engaging the rear panel 252 with the front panel lip 275 matingly engaging/overlapping the rear panel lip 276. In this embodiment, there is not side panel lip along the back or bottom edges, as shown. In this embodiment, the stay 125 is hollow box structure defined by the interior of the front panel 202 and back panel 252 and the stay sides 240 that extend between the front and back panels 202 and 252, respectively.

Figure 5:
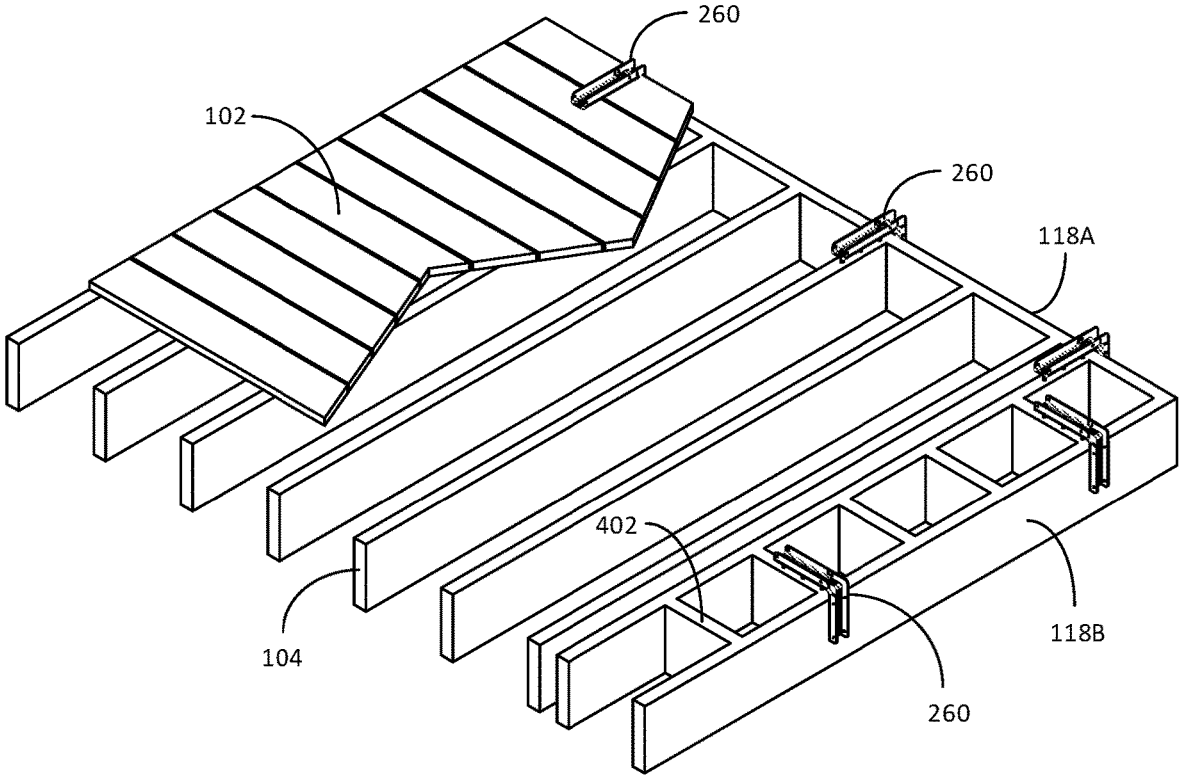
FIG. 5 is an isometric view of edge mount brackets mounted a deck embodiment consistent with embodiments of the present invention.

FIG. 5 is an isometric view of edge mount brackets mounted to a deck embodiment consistent with embodiments of the present invention. As shown, the decking 102 is cut away to reveal the joists 104 normally underneath the decking 102. On top of the decking 102 are plurality of edge mount brackets 260 that are screwed or bolted into the deck joists 104 along the back edge 118A and the blocking joists 402 along the side edge 118B. Certain embodiments envision the joists 104 being steel joists that can receive the bolts 270 from the underside of the joists 104. Optionally, the joists 104 are wood whereby the edge mount brackets 260 are screwed in.

Figure 6A:
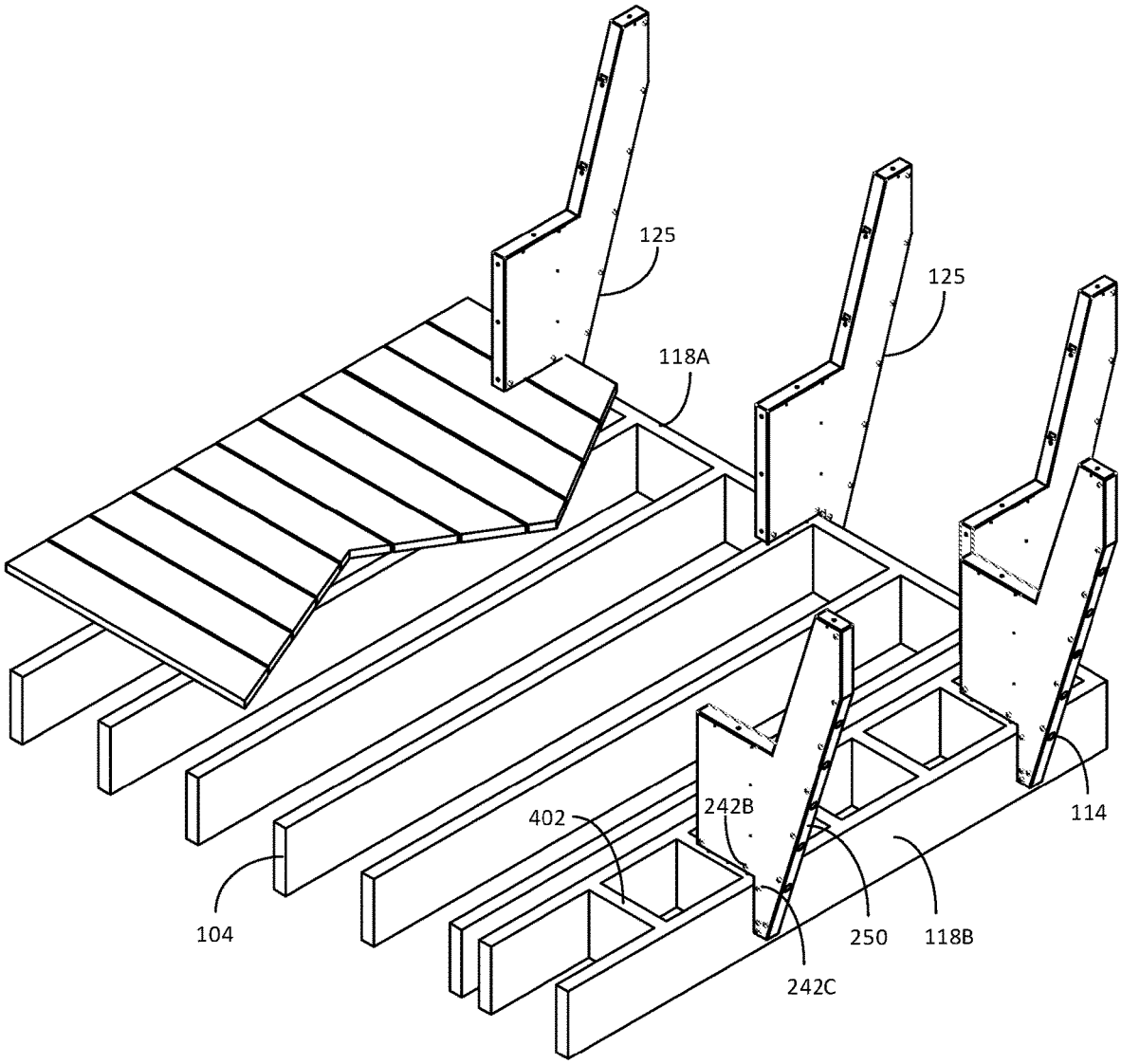
FIGS. 6A and 6B are line drawings of edge mount stays connected to the edge mount brackets on a deck consistent with embodiments of the present invention.
Figure 6B:
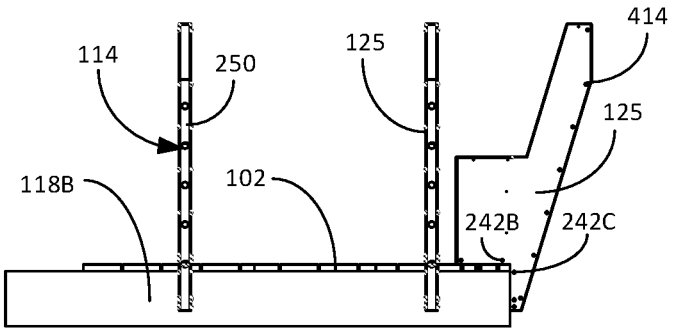

FIGS. 6A and 6B are line drawings of edge mount stays 125 connected to the edge mount brackets 260 on a deck 102 consistent with embodiments of the present invention. FIG. 6A is an isometric line drawing of five edge mount stays 125 connected to the edge mount brackets 260 of FIG. 5. After the edge mount brackets 260 are mounted to the joists 104 (or blocking joists 402) and side edges 118A and 118B via the decking 102, the edge mount stays 125 are screwed or optionally bolted onto the edge mount brackets 260 (via screw holes 241A to 242A, 241B to 242B, 241C to 242C, and 241D to 242D). As further shown, each edge mount stay 125 possesses five LEDs 114 along the respective rear stay sides 250, which serve as accent illumination.

FIG. 6B is a side view line drawing of the edge mount stays 125 mounted to the decking 102 and the side edges 118A and 118B. The five lights 114 are shown along the rear stay sides 250. In the present embodiment, the edge mount stays 125 are sheet-metal panels screwed together via screws 414.

Figure 7A:
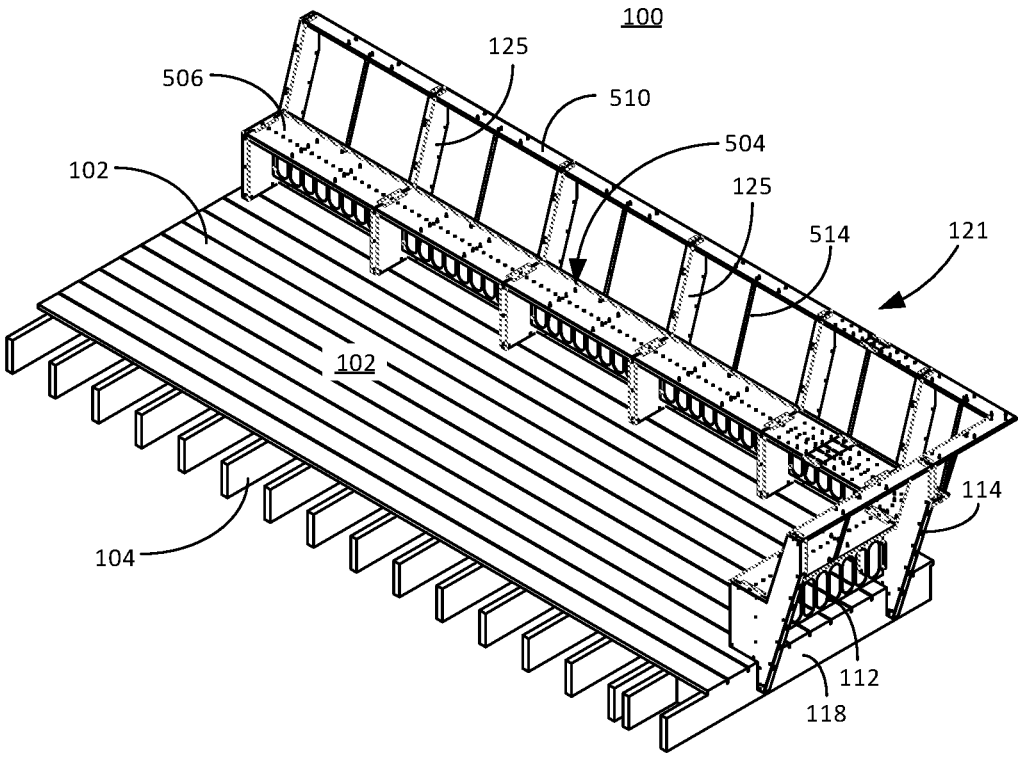
FIGS. 7A and 7B are line drawings of a deck embodiment showing seating and cap rail substrate templates consistent with embodiments of the present invention.
Figure 7B:
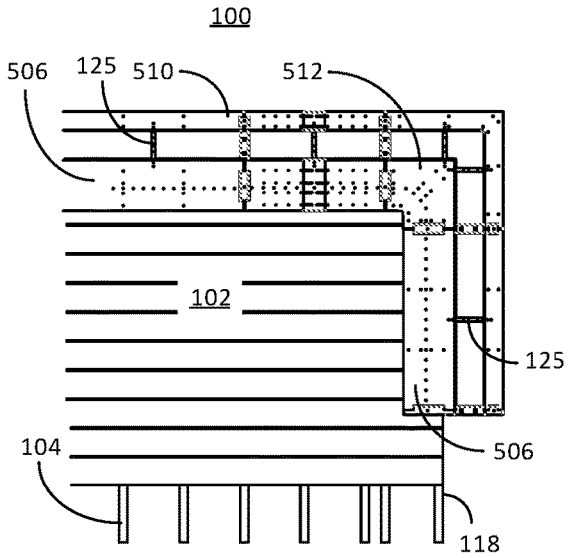

FIGS. 7A and 7B are line drawings of a deck embodiment showing seating and cap rail substrate templates consistent with embodiments of the present invention. FIG. 7A is an isometric line drawing of a deck embodiment showing seating substrate templates 506 and cap rail substrate templates 510 prior to installing deck seat planks 106, deck seat backing planks 108 or a cap rail 110. In the present embodiment, the seating substrate templates 506 are sheet-metal platforms that provide structural support for the seat planks 106. As can be seen, the seating substrate templates 506 are attached in sections to the seat edge 206 and have screws 504 that extend upward towards where the seating planks 106 are to be attached. Similarly, the cap rail substrate templates 510 are sheet-metal platforms that provides structural support for the cap rail 110. As can be seen, the cap rail substrate templates 510 are attached in sections to the cap rail edge 210 and have screws 504 that extend upwardly to engage the cap rail 110 for attachment thereto. Additional backing plank supports 514 are between the edge mount stays 125 and are for supporting the deck seat backing planks 108. FIG. 7B is a top view line drawing of a portion of the deck embodiment depicted in FIG. 7A. As shown, the seating substrate templates 506 join at a corner Miter substrate template 512.

Figure 8B:
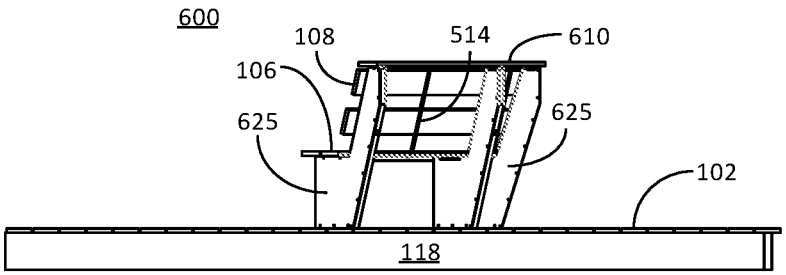

FIGS. 8A and 8B are line drawings of yet another outdoor deck embodiment with surface mount deck seating consistent with embodiments of the present invention. FIG. 8A is an isometric line drawing of an outdoor deck 600 with surface mount deck seating 622. Some of the major components of the surface mount deck embodiment 600 include a plurality of surface mount support stays 625 (hereinafter "surface mount stays") dispersed in the center and on top of the decking 102. The decking is attached to the deck joists 104. As with the edge mount deck embodiment 100 of FIG. 1A, the surface mount stays 625 include deck seat planks 106, deck seat backing planks 108 and a cap rail 110. FIG. 8B is a side view line drawing of the deck side 120 showing the surface mount deck seating 622 fixedly attached to the decking 102 and the middle the deck 600. For reference, the backing plank supports 514 are shown between the surface mount stays 625 to help support the deck seat backing planks 108.

Figure 9A:
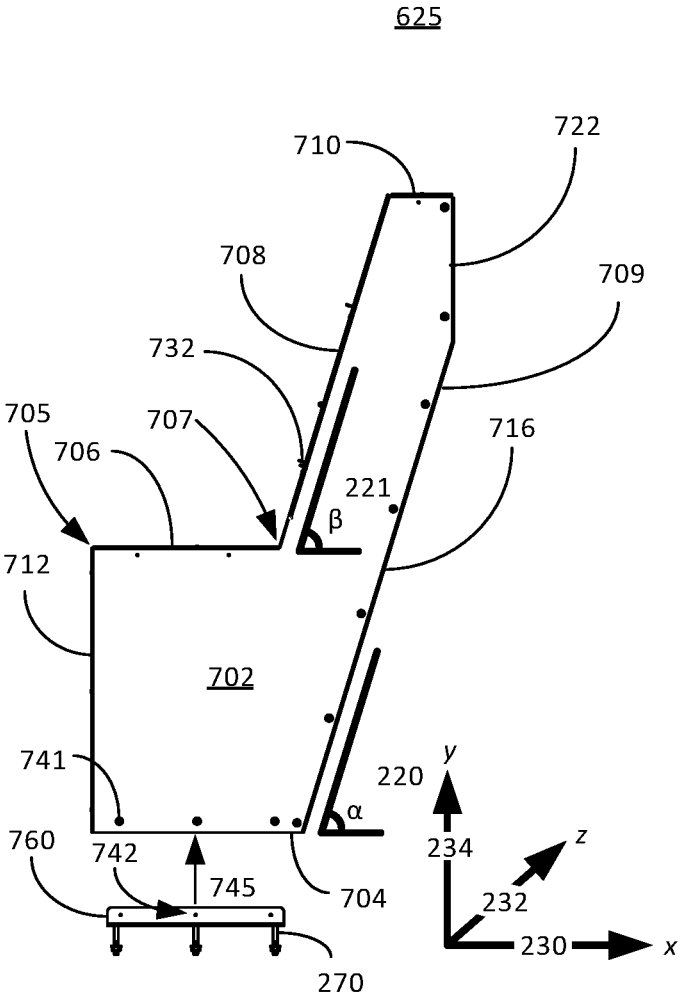
FIGS. 9A-9C are various line drawing views of a surface mount stays consistent with embodiments of the present invention.
Figure 9B:
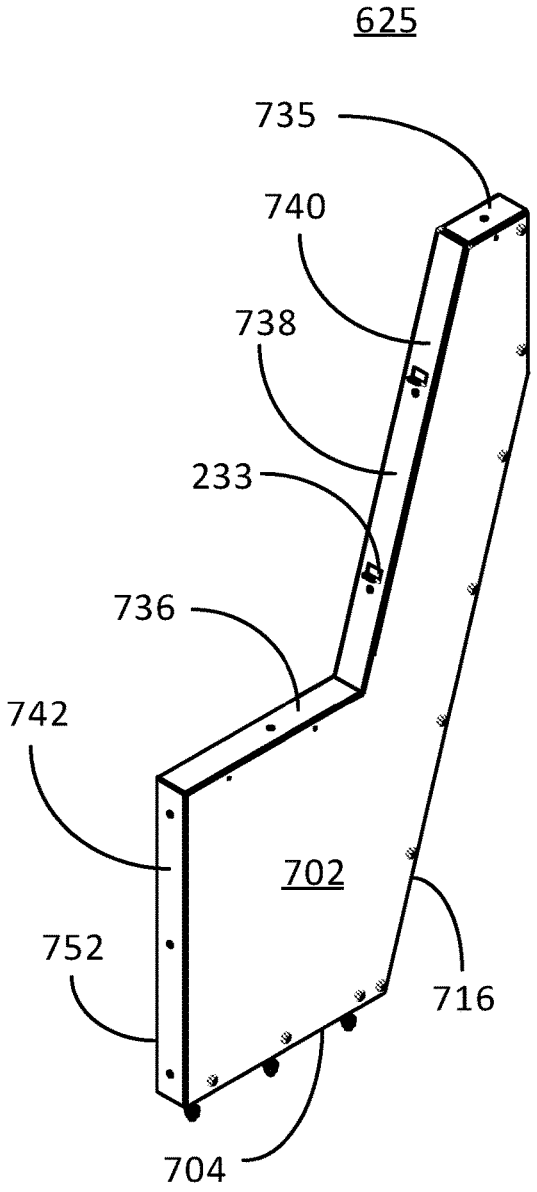
Figure 9C:
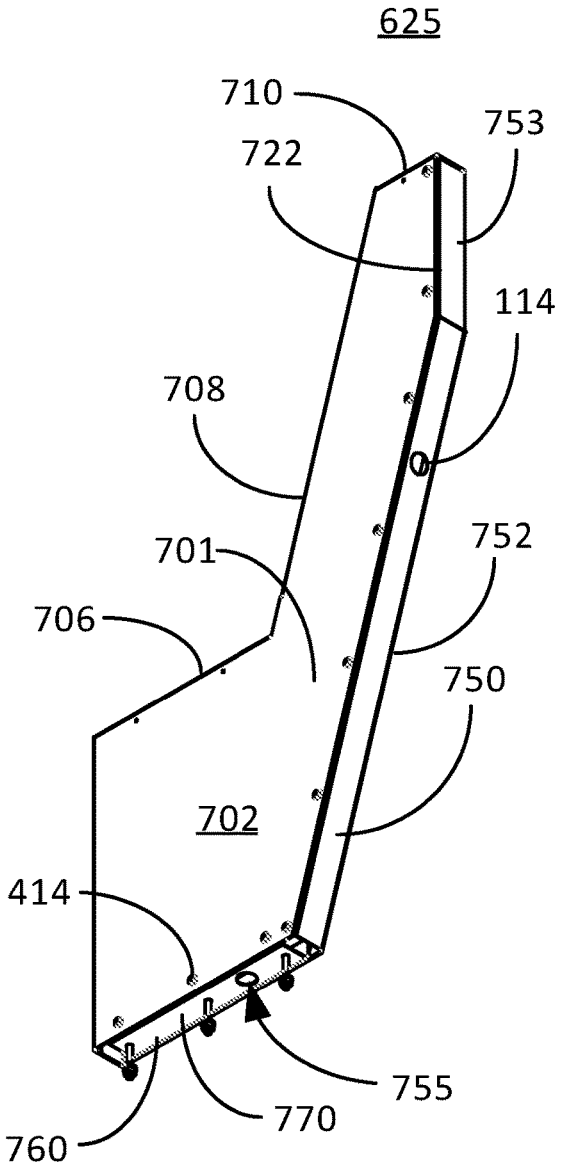

FIGS. 9A-9C are various line drawing views of a surface mount stays consistent with embodiments of the present invention. FIG. 9A shows a side view of a surface mount stay 625 wherein the outer perimeter 709 of the front panel 702 is geometrically defined by a plurality of edges. In this embodiment the outer perimeter 709 is defined by a base edge 704 that is connected to a base-to-seat edge 712 that is connected a seat edge 706 that is connected to a seat trailing edge 708 that is connected to a cap rail edge 710 that is connected to top-to-rear edge 722 that is connected to rear edge 716 that is connected to the base edge 704. More specifically, the base edge 704, the seat edge 706 and the cap rail edge 710 are parallel to one another, all extending in the horizontal 'x' direction 230. The base-to-seat edge 712 joins the base edge 704 and the seat edge 706, which in this embodiment is in the vertical 'y' direction 234. Optional embodiments envision the base-to-seat edge 712 being at an angle between 60° and 120° from the horizontal 'x' direction 230. In that light, an angle of 120° will increase the length of the seat edge 706 by extending out the seat edge leading end 705 therefore accommodating a larger seat with potentially more deck seat planks 106. The cap rail edge 710 is horizontal 230 to accommodate drinks or other objects to be set thereon. It should be appreciated that the top rail edge 710 does not need to be horizontal. The backrest edge 208 extends at an angle β 221 between 60° and 90° from the horizontal 'x' direction 230 from a seat trailing end 707 to the cap rail edge 710. The backrest edge 708 ultimately supports deck backing planks 108. Some embodiments contemplate a more comfortable backrest position for person sitting on a bench that is built with a plurality of surface mount stays 625 having an angle β 221 between 60° and 80°, which in some embodiments is up to 90°. In the present embodiment, the top-to-rear edge 722 is vertical 234 (in the 'y' direction) and extends from the cap rail edge 710 to the rear edge 716, which is at an angle α 220 between 65° and 90° from the horizontal 'x' direction 230. In this arrangement the angle β 221 is the same as the angle α 220. It should be appreciated that the top-to-rear edge 722 need not be vertical 234 but can be at other angles, such as the angle β 221 (essentially making the top-to-rear edge 722 and extension of the rear edge 716). A surface mount bracket 760 is adapted to be connected to the 704 in the direction of the arrow 745 the screw holes 742 align with the screw holes 741 where they can be fixedly connected by way of screws (not shown).

FIG. 9B shows a front view isometric line drawing of the center mount stay embodiment 625 whereby the front panel 702 is separated from the back panel 752 by way of stay sides 740 that extend in the 'z' direction 232. In this embodiment, the back panel 752 is the mirror image of the front panel 702, which in this embodiment is a flat metal sheet, that is between 1/16-1/8 of an inch, but could be as thick as 0.3 inches, with a flat outward facing surface 701. The stay sides 740, which can also be in the thickness range as the panels 702 and 752, join the front panel 702 to the back panel 752 to create a hollow box like structure as shown defined by the sides 740 and panels 702 and 752. The stay sides 740 shown in this perspective include a base-to-seat side 742, a seat side 736, a bracket side 738 and a cap rail side 735, which can be a single sheet metal element or individual sheet metal elements. Certain embodiments envision the stay sides 740 being U-shaped and fitting inside/between the front panel 702 and the rear panel 752. The U-shaped stay sides 740 can be attached to the front panel 702 and the rear panel 752 by way of bolts or screws (not shown) via threaded holes 247. Optionally, the U-shaped sides 740 can be snapped in place by way of snapping features (not shown) that would be known and understood by those skilled in the art. At least two backing support lips 233 extend from the backrest side 238 to support and align deck seat backing planks 108. Certain embodiments contemplate dimensions and angles following closely with the embodiment described in conjunction with FIG. 2A.

FIG. 9C shows a back view isometric line drawing of the center mount stay embodiment 625 of FIG. 9B. The top-to-rear edges 722 are connected to a top-to-rear stay side 753 and the rear edges 716 are connected to a rear stay side 750. The rear stay sides 750 possess at least one light receiving aperture that can support a light 114. The surface mount bracket 760 essentially forms a base stay side 770 when attached to the front panel 702 and rear panel 752 via screws 414. The surface mount bracket 760 comprises a bracket aperture 755 to provide access for an electrical cord to connect to the light 114.

Figure 10A:
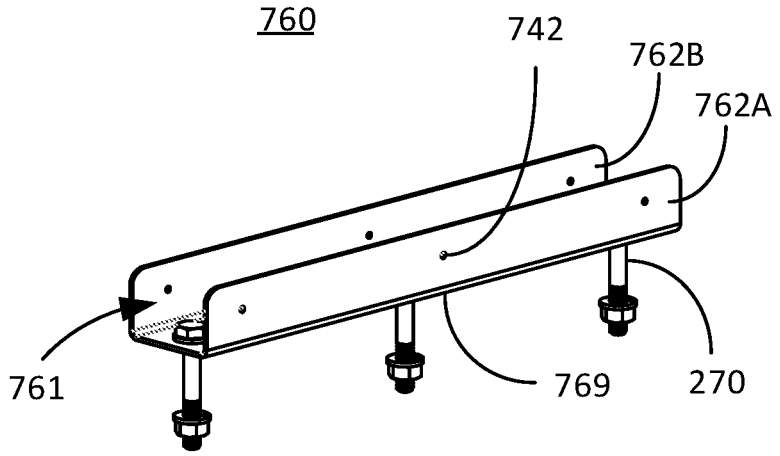
FIGS. 10A and 10B are various line drawings of a surface mount bracket consistent with embodiments of the present invention.
Figure 10B:
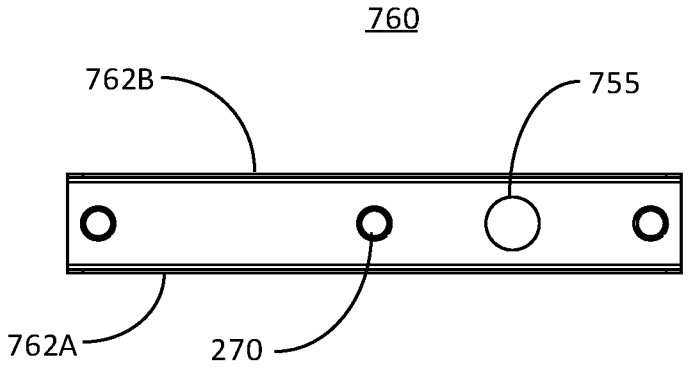

FIGS. 10A and 10B are various line drawings of a surface mount bracket consistent with embodiments of the present invention. FIG. 10A is an isometric view line drawing of a surface mount bracket embodiment 760 prominently showing the channel 761 as well as other features. Three bolts 270 extend from the bracket decking surface 769 to fixedly attach or otherwise lock onto the decking surface 102 via cooperating nuts. The base edge channel sides 762A and 762B mating the engage, i.e., butt-up against and attach to, the interior surfaces of the front panel 702 and the rear panel 752. FIG. 10B is a top view of the interior channel portion of the surface mount bracket 760 referencing the bolts 270, and the base edge channel sides 762A and 762B.

Figure 11A:
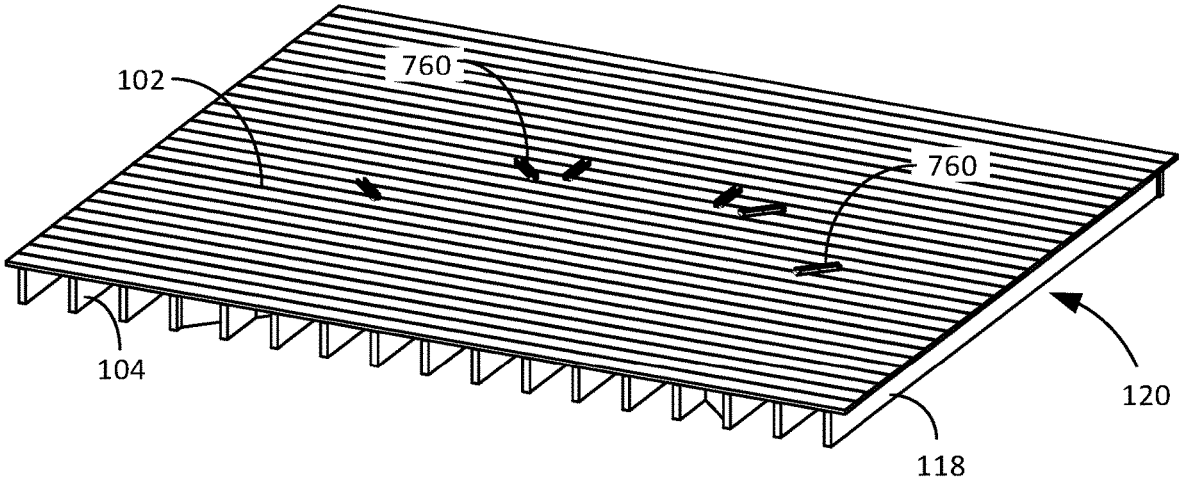
FIGS. 11A and 11B are line drawings illustratively depict mounting bracket and seat stay attachment consistent with embodiments of the present invention.
Figure 11B:
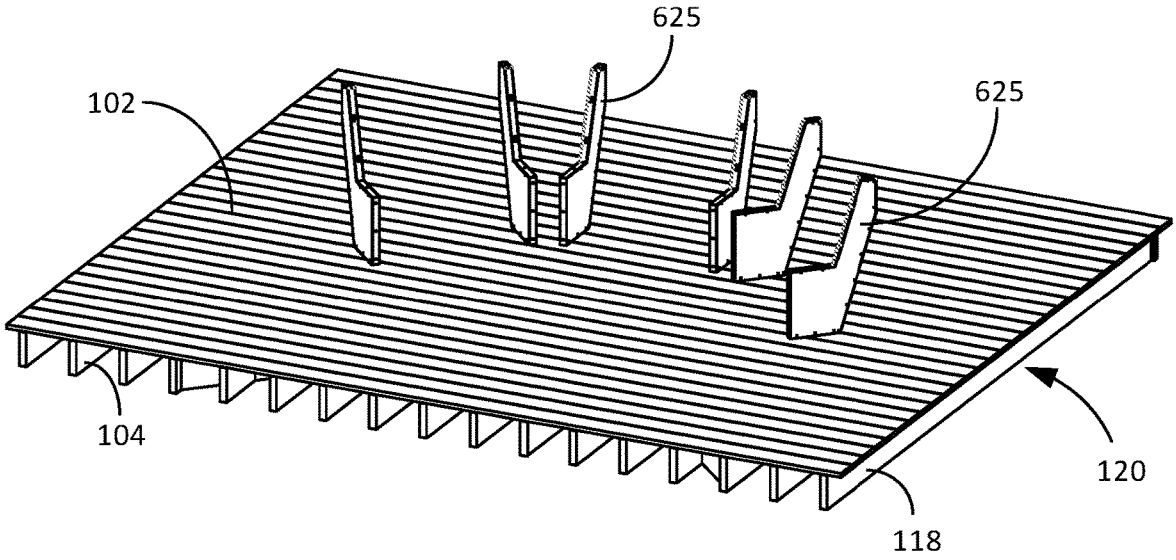

FIGS. 11A and 11B are line drawings illustratively depict mounting bracket and seat stay attachment consistent with embodiments of the present invention. FIG. 11A is an isometric line drawing of the decking 102 attached to the joists 104 with surface mount brackets 760 attached in a configuration to receive surface mount stays 625. FIG. 11B is a line drawing with the surface mount stays 625 connected to the surface mount brackets 760 of FIG. 11A.

Figure 12A:
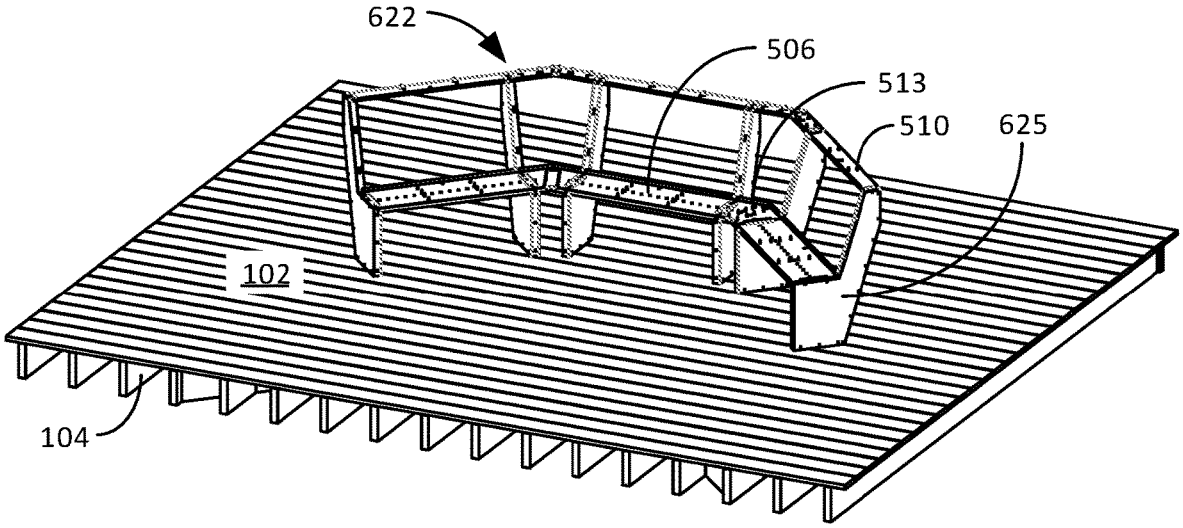
FIGS. 12A and 12B are line drawings of the deck embodiment of FIG. 8A showing seating and cap rail substrate templates consistent with embodiments of the present invention.
Figure 12B:
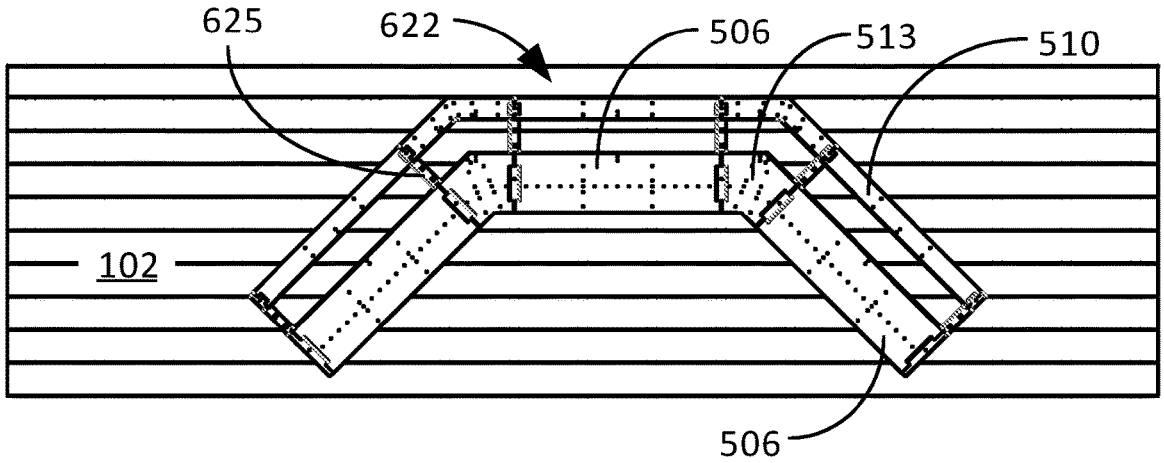

FIGS. 12A and 12B are line drawings of the deck embodiment of FIG. 8A showing seating and cap rail substrate templates consistent with embodiments of the present invention. FIG. 12A is an isometric line drawing of a deck embodiment 622 showing seats substrate templates 506 and cap rail substrate templates 510 prior to installing deck seat planks 106, deck seat backing planks 108 or a cap rail 110. In the present embodiment, the seating substrate templates 506 and cap rail substrate templates 510 are more or less described in conjunction with FIG. 8A. Because in the present embodiment the seats are arranged at a 135° angle from one another, the seat substrate templates 506 are joined by 135° corner Miter substrate templates 513. FIG. 12B is a top view line drawing of the deck embodiment 622 of FIG. 12A.

With the present description in mind, below are some examples of certain embodiments illustratively complementing some of the apparatus embodiments discussed above and presented in the figures to aid the reader. Accordingly, the elements called out below are provided by example to aid in the understanding of the present invention and should not be considered limiting. The reader will appreciate that the below elements and configurations can be interchangeable within the scope and spirit of the present invention. The illustrative embodiments can include elements from the figures.

In that light, certain embodiments of the present invention contemplate a deck seat support stay 125 comprising that generally comprises a sheet metal front panel 202 defined by at least an outer front perimeter 209 that includes a base edge 204, a seat edge 206 and a cap rail edge 210 that are parallel to one another and extend in a horizontal direction 230, a base-to-seat edge 212 that joins the base edge 204 and joins the seat edge 206, a back rest edge 208 that joins the seat edge 206 to the cap rail edge 210, the back rest edge 208 is at an angle β from the horizontal direction 230 between 65° and 90° from the horizontal direction 230, and a rear edge 216 that extends between the cap rail edge 210 and at least to the base edge 204. The deck seat support stay 125 further comprises a sheet metal back panel 252 defined by an outer back perimeter 259 that is substantially a mirror-image of the sheet metal front panel 202. The sheet metal front panel 202 and the sheet metal back panel 252 are joined and spaced apart via stay sides 240, wherein the sheet metal front panel 202, the sheet metal back panel 252 and the stay sides 240 are less than 0.3 inches thick. The deck seat support stay 125 is hollow and is attached to a patio deck 100.

In another deck seat support stay embodiment 125, the sheet metal front panel 202 is envisioned having a front panel stay side 275 that overlaps with a back panel stay side 276 from the sheet metal back panel 252 in a mating relationship. In this embodiment, the sheet metal front panel 202 is clam shelled together with the sheet metal back panel 252 via the front and the back panel stay sides 275 and 276 as shown in FIG. 4F.

The deck seat support stay embodiment 125 can further comprise a second deck seat support stay 125B that is identical to the deck seat support stay 125 is spaced apart from the deck seat support stay 125 with a plank extending from the with a seat plank 106 extending from the seat edge 206 to a second seat edge 206B of the second deck seat support stay 125B. A back rest plank 108 is further envisioned to extend from the back rest edge 208 to a second back rest edge 208B from the second deck seat support stay 125B.

An embodiment of the deck seat support stay 125 is further envisioned to have the rear edge 216 terminating at an edge joiner 219 that is beyond the base edge 204, wherein a lip edge 218 extends between the edge joiner 219 and the base edge 204. The lip edge 218 is adapted to extend below the patio deck 100 and the base edge 204 is configured to rest on a surface of the patio deck 100.

The deck seat support stay embodiment 125 further envisioning the base edge 204 being configured to rest on a surface of the patio deck 100.

In another embodiment of the deck seat support stay embodiment 125, the sheet metal front panel 202 and the sheet metal back panel 252 cooperate with an attachment bracket 760 via bracket sides 762A and 762B that extend into the deck seat support stay 125 from the base edge 204 towards the seat edge 206.

The deck seat support stay embodiment 125 further contemplates the base edge 204, the seat edge 206, the cap rail edge 210, base-to-seat edge 212, the back rest edge 208 and the rear edge 216 all being linear.

The deck seat support stay 125 further imagines a top-to-rear edge 222 that joins the cap rail edge 210 and the rear edge 216.

In another option of the deck seat support stay embodiment 125, the sheet metal front panel 202 and the sheet metal back panel 252 are each a unitary panel, meaning they are each one piece.

The deck seat support stay embodiment 125 can further include a second deck seat support stay 125B, that is essentially identical to the deck seat support stay 125, being mounted to the patio deck 100 at a predetermined distance from the deck seat support stay 125, a plank 110 being mounted to the cap rail edge 210 and a second cap rail edge 210B of the second deck seat support stay 125B, the plank 110 configured to be a shelf.

Another embodiment of the present invention envisions a deck seat stay 125 that generally comprises a unitary front panel 202 consisting of sheet metal that is less than 0.3 inches thick 272 with a perimeter 209 that includes a base edge 204 defined in a horizontal direction 230, a base-to-seat edge 212 extending from the base edge 204 to a seat edge 206, the base edge 204 joins the seat edge 206 at a seat edge leading end 205, the seat edge 206 is vertically 234 above the base edge 204, a back rest edge 208 extending at an angle β between 60° and 90° from the horizontal direction 230 and terminating at a cap rail edge 210, the back rest edge 208 extending in a positive vertical direction 234 from a seat edge trailing end 207, the cap rail edge 210 extending in the horizontal direction 230 and terminating into a rear edge 216, the rear edge 216 extending between the base edge 204 to the cap rail edge 210 at an angle α from the horizontal direction 230 between 65° and 90° from the horizontal direction 230. The deck seat stay 125 further including a unitary back panel 252 that is substantially identical and a mirror image of the unitary front panel 202. The unitary back panel 252 is joined to the unitary front panel 202 via a perimeter side 240 that spans the perimeter, wherein the perimeter side 240 is less than 0.3 inches thick. In this embodiment, the deck seat stay 125 is a hollow box structure. A hollow box structure is not merely a compartment in the deck seat stay 125 but the void that makes up the interior volume between the unitary front and back panels 202 and 204 as well as the perimeter side 240 dominates the volume of the deck seat stay 125. Meaning, the volume of the deck seat stay 125 is primarily the void inside of the deck seat stay 125.

This deck seat stay embodiment 125 further envisions that the deck seat stay 125 is attached to a patio deck 100.

The perimeter 209 of the deck seat stay embodiment 125 can further be defined by a lip edge 218 that extends vertically from the base edge at 90° in a negative direction opposite the positive direction, wherein the lip edge 218 meeting the rear edge 216. The lip edge 218 is part of the unitary front panel 202. This can further be wherein the perimeter 209 is further defined by a lip edge joiner 219 that connects the lip edge 218 with the rear edge 216. Optionally, the rear edge 216 and the base edge 204 can be configured to fixedly attach to an edge bracket 260 that is affixed to a deck edge 118. The edge bracket 260 can optionally be a U-channel bracket that extends into the deck seat stay 125 and connects to a front panel interior surface 213 of the unitary front panel 202 and a back panel interior surface 249 of the unitary back panel 252.

The rear edge 216 of the deck seat stay embodiment 125 can be optionally connected to the base edge 204.

The unitary front panel 202 of the deck seat stay embodiment 125 can optionally have a front panel stay side 275 that overlaps and is connected to a back panel stay side 275 of the unitary back panel 252 in a mating relationship, the unitary front panel 202 is clam shelled together with the unitary back panel 252 via the front and the back panel stay sides 275 and 276, respectively.

Still another embodiment of the present invention envisions a deck seat stay 125 comprising a front panel 202 that is a unitary sheet of metal less than 0.3 inches thick. The front panel 202 has a perimeter 209 that includes a base edge 204, a seat edge 206 and a cap rail edge 210 that are defined in a horizontal direction when the deck seat stay is mounted to a deck, a back rest edge 208 extending from the seat edge 206 to the cap rail edge 210 at an angle β between 60° and 90° from the horizontal direction 230. A back panel 252 that is substantially identical and a mirror image of the front panel 202 is joined to the front panel 202 via a perimeter side 240 that is less than 0.3 inches thick. The deck seat stay 125 is configured to attach to a patio deck 100. The front panel 202 can optionally have a front panel stay side 275 that overlaps and is affixed to a back panel stay side 276 of the back panel 252.

Yet another embodiment of the present invention contemplates a deck seat support stay 125 comprising: a front face 201 of a front panel 202 defined by at least an outer front perimeter 209 that includes a base edge 204, a seat edge 206 and a cap rail edge 210 that are parallel to one another and extend in a horizontal direction 230, a base-to-seat edge 212 that joins the base edge 204 joins the seat edge 206, a back rest edge 208 that joins the seat edge 206 to the cap rail edge 210, the back rest edge 208 is at an angle β 221 from the horizontal direction 230 between 65° and 90° from the horizontal direction, a rear edge 216 that extends between the cap rail edge 210 and at least to the base edge 204; a back face 251 of a back panel 252 defined by an outer back perimeter 259 that is substantially a mirror-image of the front panel; and stay sides 240 extend in the Z direction from the front panel to the back panel and joins the front panel to the back panel.

The deck seat support stay 125 embodiment further contemplating wherein the stay sides 240 the front panel and the back panel define a hollow box structure 126. This embodiment additionally contemplating wherein the stay sides 240 extend from each of the front panel and the back panel and are shelled together in an overlapping arrangement to form the box structure 126.

The deck seat support stay 125 embodiment further envisioning wherein the front panel further defining a lip edge 218 that extends in the opposite direction as the back rest edge 208 at 90° to the base edge 204, the lip edge 218 essentially joins to the rear edge 216. This embodiment additionally envisioning wherein the lip edge 218 joins the rear edge 216 by way of a lip edge joiner 219. Optionally, this embodiment envisioning wherein the front panel and the back panel cooperate with an attachment bracket 260 or 760 via bracket sides 264A and 264B, the attachment bracket 260 attaches to a deck 102 along an attachment bracket base 269.

The deck seat support stay 125 embodiment further imagining wherein the base edge 204, the seat edge 206, the cap rail edge 210, base-to-seat edge 212, the back rest edge 208 and the rear edge 216 are all linear.

The deck seat support stay 125 embodiment further considering wherein a top-to-rear edge 222 joins the cap rail edge 210 and the rear edge 216.

The deck seat support stay 125 embodiment further contemplating wherein a second deck seat support stay 125B, that is essentially identical to the deck seat support stay 125, is mounted to a deck 102 at a predetermined distance 106 from the deck seat support stay 125 and a seat plank is mounted to the seat edge 106 of both of the deck seat support stay 125 and the second deck seat support stay 125, which is also mounted to the deck 102.

Yet another embodiment of the present invention imagines a deck seat stay 125 comprising: a front panel 202 defined by a perimeter 209 that includes a base edge 204 defined in a horizontal direction 230, a base-to-seat edge 212 extending at least partially vertically 234 to join a seat edge 206 at a seat edge leading end 205, the seat edge 206 is vertically 234 above the base edge 204, a back rest edge 208 extending at an angle β between 60° and 90° from the horizontal direction 230 and terminating at a cap rail edge 210, the back rest edge 208 extending in a positive direction from a seat edge trailing end 207, the cap rail edge 210 extending in the horizontal direction 230 and terminating into a rear edge 216, the rear edge 216 extending from the base edge 204 to the back rest edge 208 at an angle α 220 from the horizontal direction 230 between 65° and 90° from the horizontal direction; and a back panel 252 that is the mirror image of the front panel 202, the back panel 252 joined to the front panel 202 via a perimeter side 240.

stay 125 stay 125 The deck seat stay 125 embodiment further contemplating wherein the perimeter 209 is further defined by a lip edge 218 that extends vertically 234 from the base edge 204 at 90° in a negative direction opposite the positive direction, the lip edge 218 meeting the rear edge 216. The perimeter 209 can further be defined a lip edge joiner 219 that connects the lip edge 218 with the rear edge 216. Optionally, the rear edge 216 and the base edge 204 can be configured to fixedly attach to an edge bracket 260 that is affixed to a deck edge 118 wherein the edge bracket 260 can defined by a U-channel bracket that connects to a front panel interior surface 213 of the front panel 202 and a back panel interior surface 249 of the back panel 252.

The deck seat stay 125 embodiment further conceiving wherein the rear edge 216 is connected to the base edge 204. The base edge 204 can be configured to fixedly attach to a surface mount bracket 760 that is affixed to a deck surface 102.

Still another embodiment of the present invention envisions a deck seat component 125 comprising: a panel 202 defined by a deck seat perimeter 209, the deck seat perimeter 209 defined by a rear edge 216 extending in a positive vertical direction 234A at an angle α 220 between 55° and 90°, the angle α 220 having an α-base 225 defined from a positive horizontal direction 230A, the rear edge 216 connecting to a top-to-rear edge 222, top-to-rear edge 222 extending in the positive vertical direction 234A at an angle α 220 between 55° and 90° from the rear edge 216, the top-to-rear edge 222 connecting to a cap rail edge 210, the cap rail edge 210 extending in a negative horizontal direction 230B at an angle α 220 of approximately 0° from the top-to-rear edge 222, the cap rail edge 210 connecting to a back rest edge 208, the back rest edge 208 extending in a negative vertical direction 234B at an angle β 221 between 55° and 90° from the cap rail edge 210, the angle β 221 having a β-base 226 defined from the positive horizontal direction 230A, the back rest edge 208 is connected to a seat edge 206, the seat edge 206 extending in a negative horizontal direction 230B at an angle α 220 of approximately 0° from the back rest edge 208, the seat edge 206 is connected to base-to-seat edge 212, the base-to-seat edge 212 extending in the negative vertical direction 234B from the seat edge 206, the base-to-seat edge 212 connected to a base edge 204, the base edge 204 extending in the positive horizontal direction 230A at an angle α 220 of approximately 0°, the base-to-seat edge 212 extending from the base edge 204 in a positive vertical direction 234A at an angle α 220 of between 90° and 120°, the base edge 204 extending toward the rear edge 216.

The deck seat component 125 embodiment further contemplating wherein the deck seat perimeter 209 further defined by a lip edge 218 connected to the base edge 204 and extending in the negative vertical direction 234B at 90° from the base edge 204, the lip edge 218 connects either directly with the rear edge 216 or indirectly by way of a lip edge joiner 219.

These exemplified embodiments are not exhaustive of the embodiments presented throughout the description, but rather are merely one example of a contemplated embodiment chain consistent with embodiments of the present invention. In other words, there are numerous other embodiments described herein that are not necessarily presented in the apparatus embodiment examples presented immediately above.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended embodiments are expressed. It should further be appreciated that the U-shaped edge bracket 260 or that the U-shaped surface mount bracket 760 can be equally mounted to the outside of the front face 201/701 and back face 251/271 without departing from the scope and spirit of the present invention. It should be understood and appreciated that any element described in one embodiment can be equally used and/or substituted in place of a like element in other embodiments without departing from the scope and spirit of the present invention. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the appended claims.

What is claimed is:

1. A deck seat support stay comprising:

a front face of a sheet metal front panel defined by at least an outer front perimeter that includes a base edge, a seat edge and a cap rail edge that are parallel to one another and extend in a horizontal direction, a base-to-seat edge that joins the base edge and joins the seat edge, a back rest edge that joins the seat edge to the cap rail edge, the back rest edge is at an angle β from the horizontal direction between 65° and 90° from the horizontal direction, a rear edge that extends between the cap rail edge and at least to the base edge;

a back face of a sheet metal back panel defined by an outer back perimeter that is substantially a mirror-image of the sheet metal front panel; and said sheet metal front panel and said sheet metal back panel are joined and spaced apart via stay sides forming a hollow box structure, wherein the sheet metal front panel, the sheet metal back panel and the stay sides are less than 0.3 inches thick and wherein said deck seat support stay is attached to a patio deck.

2. The deck seat support stay of claim 1, wherein the sheet metal front panel has a front panel stay side that overlaps with a back panel stay side from the sheet metal back panel in a mating relationship, the sheet metal front panel is clam shelled together with the sheet metal back panel via the front and the back panel stay sides.

3. The deck seat support stay of claim 1 further comprising a second deck seat support stay that is identical to the deck seat support stay is spaced apart from the deck seat support stay with a plank extending from the with a seat plank extending from the seat edge to a second seat edge of the second deck seat support stay, and a back rest plank extending from the back rest edge to a second back rest edge from the second deck seat support stay.

4. The deck seat support stay of claim 1, wherein the rear edge terminates at an edge joiner that is beyond the base edge, a lip edge extends between the edge joiner and the base edge, the lip edge is adapted to extend below the patio deck and the base edge is configured to rest on a surface of the patio deck.

5. The deck seat support stay of claim 1, wherein the base edge is configured to rest on a surface of the patio deck.

6. The deck seat support stay of claim 1, wherein the sheet metal front panel and the sheet metal back panel cooperate with an attachment bracket via bracket sides that extend into the deck seat support stay from the base edge towards the seat edge.

7. The deck seat support stay of claim 1, wherein the base edge, the seat edge, the cap rail edge, base-to-seat edge, the back rest edge and the rear edge are all linear.

8. The deck seat support stay of claim 1, wherein a top-to-rear edge joins the cap rail edge and the rear edge.

9. The deck seat support stay of claim 1, wherein the sheet metal front panel and the sheet metal back panel are each a unitary panel.

10. The deck seat support stay of claim 1, wherein a second deck seat support stay, that is essentially identical to the deck seat support stay, is mounted to the patio deck at a predetermined distance from the deck seat support stay, a plank is mounted to the cap rail edge and a second cap rail edge of the second deck seat support stay, the plank is configured to be a shelf.

11. A deck seat stay comprising:

a unitary front panel consisting of sheet metal that is less than 0.3 inches thick with a perimeter that includes a base edge defined in a horizontal direction, a base-to-seat edge extending from the base edge to a seat edge, the base edge joins the seat edge at a seat edge leading end, the seat edge is vertically above the base edge, a back rest edge extending at an angle β between 60° and 90° from the horizontal direction and terminating at a cap rail edge, the back rest edge extending in a positive direction from a seat edge trailing end, the cap rail edge extending in the horizontal direction and terminating into a rear edge, the rear edge extending between the base edge to the cap rail edge at an angle α from the horizontal direction between 65° and 90° from the horizontal direction; and a unitary back panel that is substantially identical and a mirror image of the unitary front panel, the unitary back panel joined to the unitary front panel via a perimeter side that spans the perimeter, the perimeter side is less than 0.3 inches thick, the deck seat stay is a hollow box structure.

12. The deck seat stay of claim 11, wherein the deck seat stay is attached to a patio deck.

13. The deck seat stay of claim 11, wherein the perimeter is further defined by a lip edge that extends vertically from the base edge at 90° in a negative direction opposite the positive direction, the lip edge meeting the rear edge, the lip edge is part of the unitary front panel.

14. The deck seat stay of claim 13, wherein the perimeter is further defined by a lip edge joiner that connects the lip edge with the rear edge.

15. The deck seat stay of claim 13, wherein the rear edge and the base edge are configured to fixedly attach to an edge bracket that is affixed to a deck edge.

16. The deck seat stay of claim 15, wherein the edge bracket is a U-channel bracket that extends into the deck seat stay and connects to a front panel interior surface of the unitary front panel and a back panel interior surface of the unitary back panel.

17. The deck seat stay of claim 11, wherein the rear edge is connected to the base edge.

18. The deck seat stay of claim 11, wherein the unitary front panel has a front panel stay side that overlaps and is connected to a back panel stay side of the unitary back panel in a mating relationship, the unitary front panel is clam shelled together with the unitary back panel via the front and the back panel stay sides.

19. A deck seat stay comprising:

a front panel that is a unitary sheet of metal less than 0.3 inches thick, the front panel has a perimeter that includes a base edge, a seat edge and a cap rail edge that are defined in a horizontal plane, a back rest edge extending from said seat edge to said cap rail edge at an angle β between 60° and 90° from the horizontal plane;

a back panel that is substantially identical and a mirror image of the front panel, the back panel joined to the front panel via a perimeter side that is less than 0.3 inches thick, the deck seat stay is configured to attach to a patio deck, wherein the patio deck defines the horizontal plane.

20. The deck seat stay of claim 19, wherein the front panel has a front panel stay side that overlaps and is affixed to a back panel stay side of the back panel.

* * * * *